US008055173B2

(12) United States Patent
Baba

(10) Patent No.: US 8,055,173 B2
(45) Date of Patent: Nov. 8, 2011

(54) FIXING APPARATUS AND IMAGE FORMING APPARATUS

(75) Inventor: Motofumi Baba, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 470 days.

(21) Appl. No.: 12/270,658

(22) Filed: Nov. 13, 2008

(65) Prior Publication Data

US 2009/0263168 A1 Oct. 22, 2009

(30) Foreign Application Priority Data

Apr. 17, 2008 (JP) ..... 2008-108349

(51) Int. Cl.
*G03G 15/20* (2006.01)

(52) U.S. Cl. ..... 399/329; 219/216; 219/619; 399/333

(58) Field of Classification Search ..... 399/329, 399/330, 333, 334, 328; 219/216, 619
See application file for complete search history.

(56) References Cited

U.S. PATENT DOCUMENTS

| | | | | |
|---|---|---|---|---|
| 6,978,110 | B2 | 12/2005 | Nakayama et al. | |
| 7,079,801 | B2 | 7/2006 | Nakayama | |
| 7,212,775 | B2 * | 5/2007 | Kachi | 399/329 |
| 2003/0095818 | A1 | 5/2003 | Nakayama | |
| 2005/0244199 | A1 | 11/2005 | Nakayama | |
| 2008/0124147 | A1 * | 5/2008 | Uehara et al. | 399/329 |
| 2008/0205948 | A1 * | 8/2008 | Baba et al. | 399/329 |
| 2008/0226326 | A1 * | 9/2008 | Seo et al. | 219/216 X |
| 2009/0232534 | A1 * | 9/2009 | Haseba et al. | 399/329 X |

FOREIGN PATENT DOCUMENTS

| | | |
|---|---|---|
| EP | 0632344 | 1/1995 |
| JP | 06-348154 | 12/1994 |
| JP | 11-288190 | 10/1999 |
| JP | 2000-030850 | 1/2000 |
| JP | 2000-335804 | 12/2000 |
| JP | 2003-186322 | 7/2003 |
| JP | 3527442 B | 2/2004 |
| JP | 2005-183122 | 7/2005 |
| JP | 2005-203273 | 7/2005 |
| JP | 2006-119510 | 5/2006 |
| JP | 3901414 B | 1/2007 |
| JP | 3931589 B | 3/2007 |

* cited by examiner

*Primary Examiner* — Sophia S Chen
(74) *Attorney, Agent, or Firm* — Morgan, Lewis & Bockius LLP

(57) ABSTRACT

The fixing apparatus includes: a fixing member having base and conductive layers and fixing a toner onto a recording medium when the conductive layer is heated by electromagnetic induction; a magnetic field generating member generating an alternating-current magnetic field crossing the conductive layer; and a magnetic field inducing member arranged so as to face the magnetic field generating member across the fixing member, and inducing the magnetic field into itself or allowing the magnetic field to go through the member. The base layer and the magnetic field inducing member each contain a material having a magnetic permeability change onset temperature in a range from not less than a heating preset temperature of the fixing member to not more than a heatproof temperature of the fixing member. A thickness of the base layer is smaller than a skin depth of the layer at the heating preset temperature of the fixing member.

11 Claims, 15 Drawing Sheets

FIXING APPARATUS AND IMAGE FORMING APPARATUS

CROSS REFERENCE TO RELATED APPLICATIONS

This application is based on and claims priority under 35 USC §119 from Japanese Patent Application No. 2008-108349 filed Apr. 17, 2008.

BACKGROUND

1. Technical Field

The present invention relates to a fixing apparatus and an image forming apparatus.

2. Related Art

As a fixing apparatus used in an image forming apparatus, such as a copying machine and a printer that each employ an electrophotographic system, an apparatus is known in which a fixing member for fixing a toner image onto a paper sheet by thermally fusing the toner image is heated by electromagnetic induction.

SUMMARY

According to an aspect of the present invention, there is provided a fixing apparatus including: a fixing member that has a base layer and a conductive layer formed therein and fixes a toner onto a recording medium when the conductive layer is heated by electromagnetic induction; a magnetic field generating member that generates an alternating-current magnetic field crossing the conductive layer formed in the fixing member; and a magnetic field inducing member that is arranged so as to face the magnetic field generating member across the fixing member, and that induces the alternating-current magnetic field generated in the magnetic field generating member thereinto or allows the alternating-current magnetic field to go therethrough, the base layer of the fixing member and the magnetic field inducing member each containing a material having a magnetic permeability change onset temperature in a temperature range from not less than a heating preset temperature of the fixing member to not more than a heatproof temperature of the fixing member, and a thickness of the base layer being smaller than a skin depth of the base layer at the heating preset temperature of the fixing member.

Here, the magnetic permeability change onset temperature is a temperature at which the magnetic permeability (JIS C 2531) starts to decrease continuously, and is a point at which a penetration amount of the magnetic flux in the magnetic field starts to change.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the attached drawings.

First Exemplary Embodiment

Figure 1:
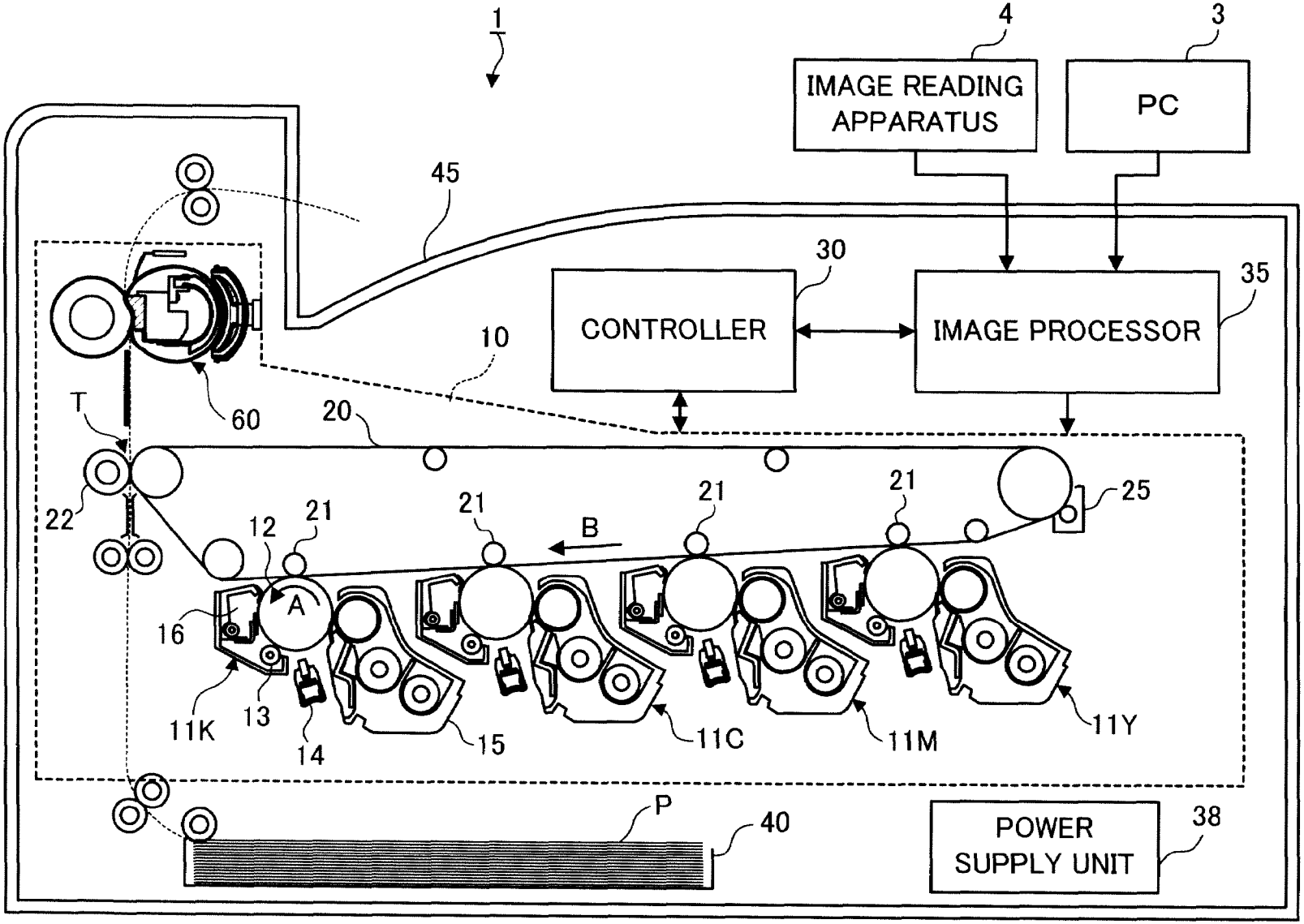
FIG. 1 is a diagram showing an entire configuration of an image forming apparatus to which the first exemplary embodiment is applied.

FIG. 1 is a diagram showing an entire configuration of an image forming apparatus 1 to which the first exemplary embodiment is applied. The image forming apparatus 1 shown in FIG. 1 is a so-called tandem-type color printer, and includes an image forming processor 10 that performs image formation in accordance with each color image data, a controller 30 that controls operation of the entire image forming apparatus 1, an image processor 35 that is connected with external apparatuses such as a personal computer (PC) 3 and the image reading apparatus 4 and that performs an image processing on image data received therefrom, and a power supply unit 38 that supplies electric power to each part of the apparatus.

The image forming processor 10 includes four image forming units 11Y, 11M, 11C and 11K (also referred to as "image forming units 11") as an example of a toner image forming unit, which are arranged in parallel at a predetermined distance. Each of the image forming units 11 includes a photoconductor drum 12 as an example of an image carrier that forms an electrostatic latent image and carries a toner image, a charging device 13 that uniformly charges a surface of the photoconductor drum 12 at certain voltage, a LED printhead 14 that exposes the photoconductor drum 12 which has been charged by the charging device 13, on the basis of image data, a developing device 15 that develops the electrostatic latent image formed on the photoconductor drum 12, and a cleaner 16 that cleans the surface of the photoconductor drum 12 after transfer.

In addition, the image forming units 11 are similarly configured with each other, except toner contained in the developing device 15. The image forming units 11Y, 11M, 11C and 11K form yellow (Y), magenta (M), cyan (C) and black (K) toner images, respectively.

Further, the image forming processor 10 includes an intermediate transfer belt 20 onto which color toner images formed on the respective photoconductor drums 12 of the image forming units 11 are multi-transferred, primary transfer rolls 21 that sequentially transfer (primarily transfer) color toner images formed in the respective image forming units 11 onto the intermediate transfer belt 20, a secondary transfer roll 22 that collectively transfers (secondarily transfers) the color toner images superimposingly transferred onto the intermediate transfer belt 20, onto a paper sheet P as a recording medium (recording paper), and a fixing apparatus 60 as an example of a fixing unit (fixing apparatus) that fixes the color toner images that have been secondarily transferred, onto the paper sheet P. It should be noted that, in the image forming apparatus 1 of the first exemplary embodiment, the intermediate transfer belt 20, the primary transfer rolls 21 and the secondary transfer roll 22 configure a transfer unit.

In the image forming apparatus 1 of the first exemplary embodiment, image data inputted from the PC 3 or the image reading apparatus 4 are subjected to an image processing operation by the image processor 35, and then the resultant data are transmitted to the image forming units 11 via an interface not shown in the figure. Then, for example, in the image forming unit 11K that forms a black (K) toner image, while rotating in an arrow A direction, the photoconductor drum 12 is uniformly charged by the charging device 13 at the certain voltage and is scanned and exposed by the LED printhead 14 in which LED (light emitting diode) array emits light on the basis of the image data transmitted from the image processor 35. Thereby, on the photoconductor drum 12, an electrostatic latent image for the black (K) image is formed. Thereafter, the electrostatic latent image formed on the photoconductor drum 12 is developed by the developing device 15, and a black (K) toner image is formed on the photoconductor drum 12. Similarly, yellow (Y), magenta (M) and cyan (C) toner images are formed in the image forming units 11Y, 11M and 11C, respectively.

The color toner images formed in the respective image forming units 11 are electrostatically attracted onto the intermediate transfer belt 20 moving in an arrow B direction by the primary transfer roll 21 in sequence, and superimposed toner images are formed. The superimposed toner images are color toner images superimposed with each other. The superimposed toner images on the intermediate transfer belt 20 are transported to a region (a secondary transfer portion T) where the secondary transfer roll 22 is arranged, according to movement of the intermediate transfer belt 20. When the superimposed toner images are transported to the secondary transfer portion T, a paper sheet P is supplied to the secondary transfer portion T from the paper sheet holder 40 at the same timing of transporting the superimposed toner images to the secondary transfer portion T. Then, the superimposed toner images are collectively and electrostatically transferred onto the transported paper sheet P by an action of the transfer electric field formed by the secondary transfer roll 22 at the secondary transfer portion T.

Thereafter, the paper sheet P on which the superimposed toner images are electrostatically transferred is peeled from the intermediate transfer belt 20 and is transported to the fixing apparatus 60. The toner images on the paper sheet P transported to the fixing apparatus 60 are subjected to fixing processing with heat and pressure by the fixing apparatus 60, and are fixed on the paper sheet P. Further, the paper sheet P on which a fixed image is formed is transported to the output paper sheet stacking unit 45 provided at an exit portion of the image forming apparatus 1.

On the other hand, toner (transfer remaining toner) attached on the intermediate transfer belt 20 after the secondary transfer is removed by the belt cleaner 25 from the surface of the intermediate transfer belt 20 after the completion of the secondary transfer, and next image forming cycle is prepared.

As described above, image formation in the image forming apparatus 1 is repeatedly executed according to the number of cycles for paper sheets to be printed.

Next, a description will be given of a configuration of the fixing apparatus 60 arranged in the image forming apparatus 1 of the first exemplary embodiment.

Figure 2:
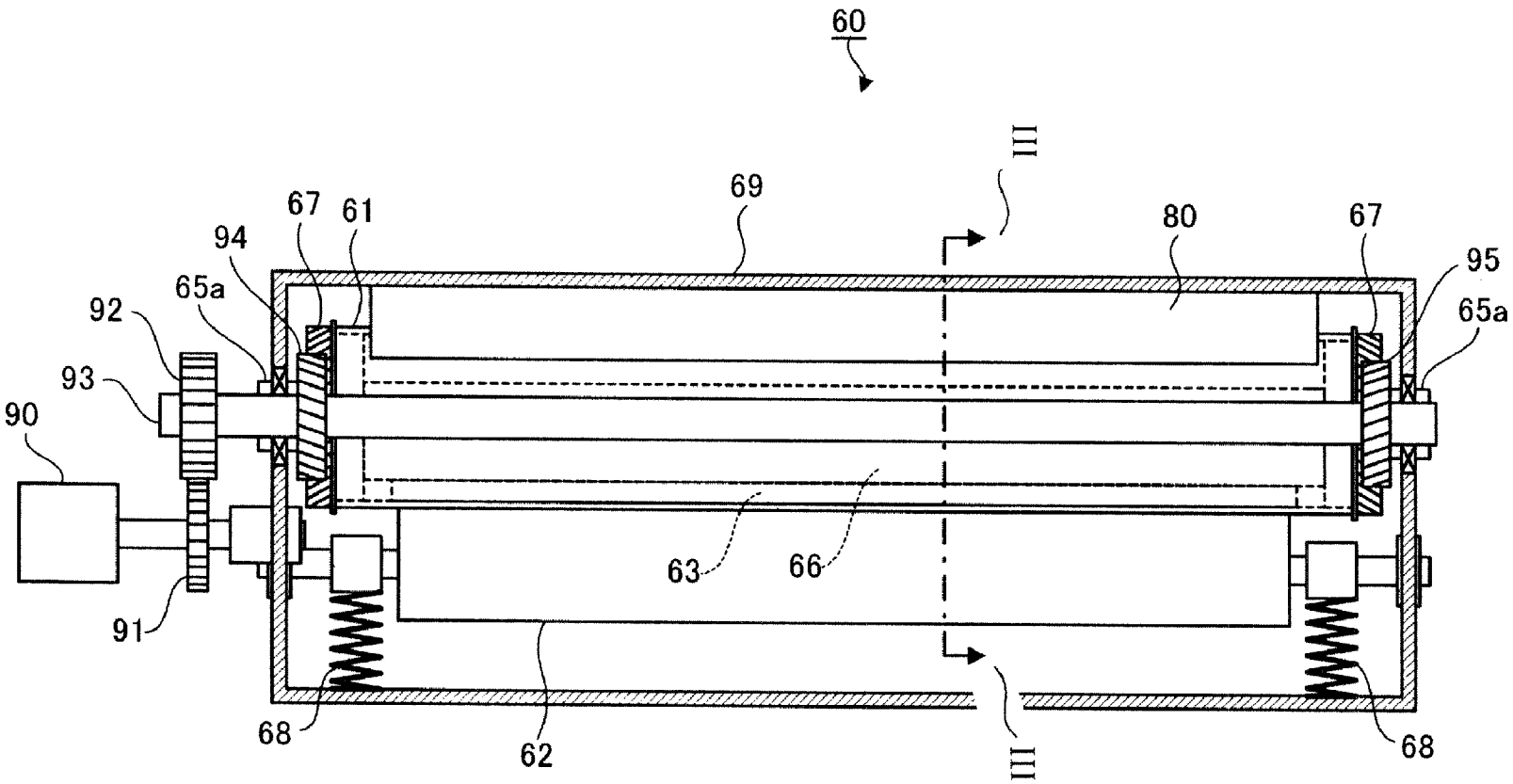
FIG. 2 is a front view showing the configuration of the fixing apparatus of the first exemplary embodiment.
Figure 3:
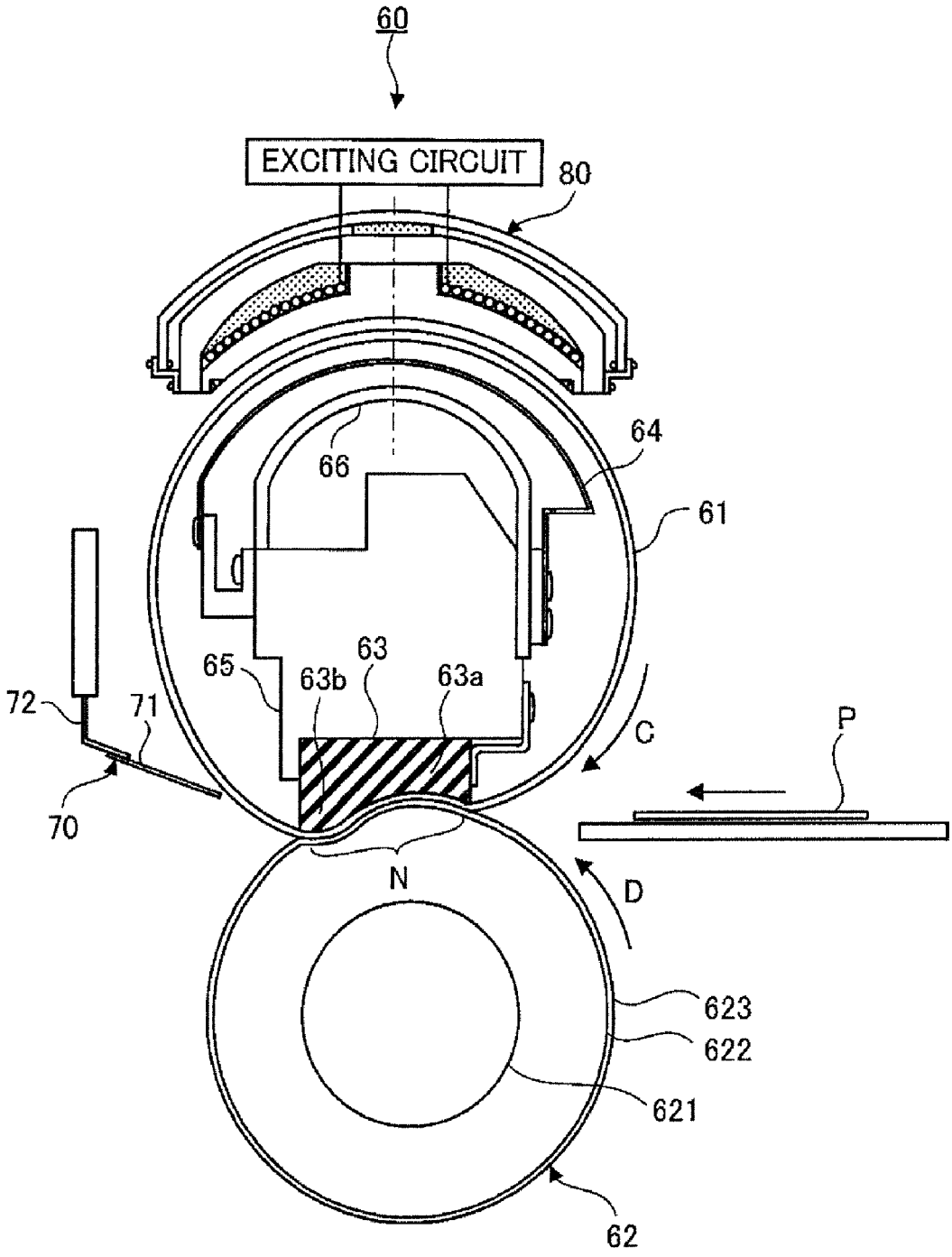
FIG. 3 is a cross-sectional view taken along the line III-III in FIG. 2.

FIG. 2 is a front view showing the configuration of the fixing apparatus 60 of the first exemplary embodiment, and FIG. 3 is a cross-sectional view taken along the line III-III in FIG. 2. Firstly, as illustrated in FIG. 3, the fixing apparatus 60 includes: an IH (induction heating) heater 80 as an example of a magnetic field generating member that generates an alternating-current magnetic field; a fixing belt 61 as an example of a fixing member that fixes toner images by generating heat when being heated by electromagnetic induction by the IH heater 80; a pressure roll 62 arranged so as to face the fixing belt 61; and a pressure pad 63 to be pressed by the pressure roll 62 through the fixing belt 61.

The fixing apparatus 60 further includes: a holder 65 that supports the pressure pad 63 and the like; a nonmagnetic metal inducing member 66 that induces a magnetic flux under a condition; a temperature-sensitive member 64 as an example of a magnetic field inducing member that forms a magnetic path by inducing an alternating-current magnetic field generated by the IH heater 80; and a peel-off supporting member 70 that supports peel-off of a paper sheet P from the fixing belt 61.

Figure 4:
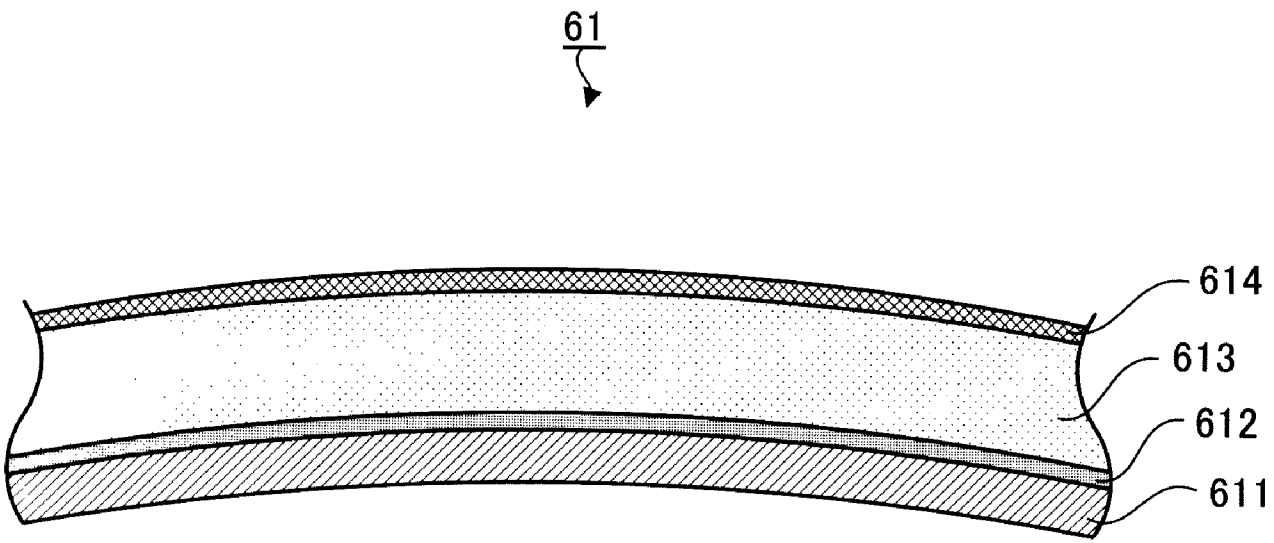
FIG. 4 is a cross-sectional view of the fixing belt.

The fixing belt 61 is composed of an endless belt member originally having a cylindrical shape, and the diameter of the original shape (cylindrical shape) is, for example, 30 mm. Furthermore, as illustrated in FIG. 4 (a cross-sectional view of the fixing belt 61), the fixing belt 61 is a belt member having a multilayer structure composed of: a base layer 611 as an example of a base layer that is a sheet-like member made of alloy having high mechanical strength; a conductive layer 612 as an example of a conductive layer stacked on the base layer 611; an elastic layer 613 that improves fixing of a toner image; and a surface releasing layer 614 that is applied to an uppermost layer.

The base layer 611 is a magnetic path forming unit that forms a magnetic path of the alternating-current magnetic field generated by the IH heater 80 as well as a base member that provides mechanical strength to the fixing belt 61. Here, the base layer 611 is made of a ferromagnetic material having a magnetic permeability change onset temperature set in a temperature range from not less than a temperature (heating preset temperature of the fixing belt 61) at which each color toner image melts, to a temperature lower than a heatproof temperature of the elastic layer 613 and the surface releasing layer 614. To be more specific, the base layer 611 is made of a material having "heat sensitivity," which changes reversibly between ferromagnetism having a relative magnetic permeability of several hundreds or above and paramagnetism (nonmagnetism) having a relative magnetic permeability of approximately 1 within a temperature region above the heating preset temperature of the fixing belt 61 (for example, a temperature range from the heating preset temperature of the fixing belt 61 to the heating preset temperature+approximately 100° C.). Here, in a temperature range below the magnetic permeability change onset temperature at which the base layer 611 exhibits ferromagnetism, the base layer 611 functions as a magnetic path forming unit that forms, inside the base layer 611, a magnetic path along a spreading direction of the base layer 611 by inducing a magnetic flux of the alternating-current magnetic field generated by the IH heater 80. In the meantime, in a temperature range above the magnetic permeability change onset temperature at which the base layer 611 exhibits paramagnetism, the base layer 611 allows the magnetic flux generated by the IH heater 80 to go through the base layer 611 so as to cut across in the layer thickness direction thereof.

As the base layer 611 of the first exemplary embodiment, to be more specific, a binary magnetic shunt steel, such as an Fe—Ni alloy (permalloy), and a ternary magnetic shunt steel, such as an Fe—Ni—Cr alloy, each of which has a magnetic permeability change onset temperature set, for example, in a range from 140° C. (the heating preset temperature of the fixing belt 61) to 240° C., are used. Because of excellent thin-walled molding property and workability, high heat conductivity, low cost, and also high mechanical strength and the like, metal alloys including such permalloy, magnetic shunt steel and the like are suitable for the base layer 611 of the fixing belt 61. As for other material, a metal alloy made of Fe, Ni, Si, B, Nb, Cu, Zr, Co, Cr, V, Mn, Mo and the like is used. For example, when a Fe—Ni binary magnetic shunt steel is set to contain Fe of 64% and Ni of 36% (by atom number ratio), a magnetic permeability change onset temperature around 225° C. is achievable.

Meanwhile, since these alloys all have a high specific resistance value of $60\times10^{-8}$ Ωm or above, it is difficult to heat them by induction when they have a thickness of 200 μm or smaller. Accordingly, an electromagnetic induction heat generating layer (refer to a description below) which is easily heated by induction is additionally required.

Furthermore, the base layer 611 is formed to have a thickness smaller than a skin depth (refer to a description below) relative to an alternating-current magnetic field (magnetic field lines) generated by the IH heater 80. To be more specific, in the case of using an Fe—Ni alloy, the thickness is set approximately in a range from 20 μm to 80 μm. It should be noted that a detailed description will be given of a function of the base layer 611.

The conductive layer 612 is an electromagnetic induction heat generating layer to be heated by electromagnetic induction using an alternating-current magnetic field generated by the IH heater 80. Since a thin film is obtainable with a nonmagnetic metal, such as Ag, Cu, and Al, having a relatively small specific resistance value and having a thickness in a range from 2 μm to 30 μm, such nonmagnetic metals may be used for forming such a layer.

In the fixing apparatus 60 of the first exemplary embodiment, on the base layer 611 composed of, for example, an Fe—Ni alloy having a thickness of 50 μm, the conductive layer 612 made of Cu having a high electric conductivity is formed by plating, deposition or the like to have a thickness of approximately 10 μm. In such a configuration, by forming the base layer 611 and the conductive layer 612 so as to be a thin layer, plasticity and flexibility of the whole fixing belt 61 are enhanced, while its mechanical strength is secured.

Here, since the base layer 611 used in the first exemplary embodiment is made of a material having a specific resistance value 10 times or more than that of the conductive layer 612, an eddy current I is less likely to flow through the base layer 611 compared to through the conductive layer 612. Accordingly, the base layer 611 is anon-heat generating layer having an ignorable amount of heat generated therein compared to the amount of heat generated in the conductive layer 612. Furthermore, even if the base layer 611 generates a very little amount of heat, such heat would be absorbed by the fixing belt 61 including the conductive layer 612.

The elastic layer 613 is composed of an elastic body made of silicone rubber or the like. A toner image to be held on a paper sheet P as a fixed object is formed by stacking each color toner in a powder form. Accordingly, in order to supply heat evenly to the whole toner image in a nip part N, the surface of the fixing belt 61 may be deformed in accordance with the roughness of the toner image on the paper sheet P. Thus, as the elastic layer 613 of the first exemplary embodiment, a silicone rubber having, for example, a thickness in a range from 100 μm to 600 μm and a hardness in a range from 10° to 30° (JIS-A) is used.

As for the surface releasing layer 614, since it comes in direct contact with an unfixed toner image held on the paper sheet P, a material having a high releasing property is used. For example, tetrafluoroethylene-perfluoroalkyl vinyl ether copolymer (PFA), polytetrafluoroethylene (PTFE), a silicone copolymer, a complex layer composed of them or the like is used. If the thickness of the surface releasing layer 614 is too small, a sufficient level of wear resistance is not achievable; therefore, the lifetime of the fixing belt 61 is shortened. On the other hand, when the thickness is too large, the heat capacity of the fixing belt 61 becomes too large; therefore, the warm-up time is prolonged. Hence, in view of the balance between the wear resistance and the heat capacity of the surface releasing layer 614 of the first exemplary embodiment, the thickness thereof is set in a range from 1 μm to 50 μm.

The pressure pad 63 is composed of an elastic body, such as silicone rubber or a fluorine-contained rubber, and supported by the holder 65 at a position facing the pressure roll 62. Then, the pressure pad 63 is arranged in a state of being pressed by the pressure roll 62 through the fixing belt 61, and forms the nip part N with the pressure roll 62 in a space therebetween.

Furthermore, the pressure pad 63 is set to have a different nip pressure in a prenip region 63*a* located at the entrance of the nip part N (on an upstream side in a transporting direction of the paper sheet P) and in a peel-off nip region 63*b* located at the exit side of the nip part N (on an downstream side in the transporting direction of the paper sheet P). To be more specific, in the prenip region 63*a*, a surface of the pressure pad 63, closer to the pressure roll 62 is formed to have a circular shape approximately in accordance with an outer peripheral surface of the pressure roll 62 so as to form a uniform nip part N having a wide width. Meanwhile, in the peel-off nip region 63*b*, the pressure pad 63 is formed so as to be pressed locally by the surface of the pressure roll 62 with a high nip pressure so that the curvature radius of the fixing belt 61 going through the peel-off nip region 63*b* may be small. By having such a configuration, a curl (down curl) is formed on the paper sheet P going through the peel-off nip region 63*b* in a direction to peel the paper sheet P from the surface of the fixing belt 61. Accordingly, peel-off of the paper sheet P from the surface of the fixing belt 61 is promoted.

Here, in the first exemplary embodiment, as a supporting unit for peel-off by the pressure pad 63, the peel-off supporting member 70 is arranged on a downstream side of the nip part N. In the peel-off supporting member 70, a peel-off baffle 71 is supported by a holder 72 so as to come close to the fixing belt 61 in a direction facing a rotational moving direction of the fixing belt 61. Then, by supporting the curled part formed on the paper sheet P with the peel-off baffle 71 at the exit of the pressure pad 63, the paper sheet P is prevented from going towards the fixing belt 61.

The temperature-sensitive member 64 is formed to have a shape in accordance with an inner peripheral surface of the fixing belt 61, and spaced from the inner peripheral surface of the fixing belt 61 by a predetermined distance so as not to be in contact with the inner peripheral surface thereof. Here, similarly to the base layer 611 of the fixing belt 61, the temperature-sensitive member 64 is made of a material having the magnetic permeability change onset temperature set in a temperature range from not less than the heating preset temperature of the fixing belt 61, at which each color toner image melts, to the temperature lower than the heatproof temperature of the elastic layer 613 and the surface releasing layer 614 of the fixing belt 61. To be more specific, the temperature-sensitive member 64 is made of a material having "heat sensitivity", which changes reversibly between ferromagnetism and paramagnetism in a temperature region including the heating preset temperature of the fixing belt 61. Here, in a temperature range of the magnetic permeability change onset temperature and below in which the temperature-sensitive member 64 exhibits ferromagnetism, the temperature-sensitive member 64 functions as a magnetic path forming unit that forms, inside the temperature-sensitive member 64, a magnetic path along a spreading direction of the temperature-sensitive member 64 by inducing a magnetic flux having generated in the IH heater 80 and having gone through the fixing belt 61. In the meantime, in a temperature range above the magnetic permeability change onset temperature, the temperature-sensitive member 64 allows the magnetic flux having generated in the IH heater 80 and having gone through the fixing belt 61 to go through the temperature-sensitive member 64 so as to cut across in the layer thickness direction thereof. Here, a material suitable for the temperature-sensitive member 64 is similar to that for the base layer 611 of the fixing belt 61.

Furthermore, the temperature-sensitive member 64 is formed to have a thickness smaller than a skin depth (refer to a description below) relative to an alternating-current magnetic field (magnetic field lines) generated by the IH heater 80. To be more specific, in the case of using an Fe—Ni alloy, the thickness is set approximately in a range from 50 μm to 300 μm. It should be noted that a detailed description will be given of a configuration and a function of the temperature-sensitive member 64.

The holder 65 that supports the pressure pad 63 is made of a material having a high rigidity so that the amount of deflection in a state where the pressure pad 63 receives a pressure force from the pressure roll 62 may be less than a certain amount. By having such a configuration, pressure (nip pressure N) applied to the nip part N in its longitudinal direction is maintained to be uniform. Furthermore, in the fixing apparatus 60 of the first exemplary embodiment, since a configuration is employed in which the fixing belt 61 is heated by electromagnetic induction, the holder 65 is made of a material which either does not affect or hardly affect an induced magnetic field and which is either unsusceptible or hardly susceptible to the induced magnetic field. For example, a heat-resistant resin, such as polyphenylene sulfide (PPS) containing glass, or a paramagnetic metal material, such as Al, Cu, Ag, is used.

As for the nonmagnetic metal inducing member 66, it is made of a nonmagnetic metal, such as Ag, Cu, Al, having a relatively small specific resistance value. Here, when heated to a temperature above the magnetic permeability change onset temperature of the base layer 611 of the fixing belt 61 and the temperature-sensitive member 64, the nonmagnetic metal inducing member 66 forms, by inducing the alternating magnetic field (magnetic field line) having generated by the IH heater 80, a state in which the eddy current I is generated more easily than in the conductive layer 612 of the fixing belt 61. In such a configuration, the nonmagnetic metal inducing member 66 is formed to have a thickness (for example, 1 mm) which is sufficiently larger than the skin depth (refer to a description below) so that the eddy current I may flow through the nonmagnetic metal inducing member 66 more easily.

Next, a driving mechanism of the fixing belt 61 will be described.

As illustrated in FIG. 2, at both ends of the holder 65 (refer to FIG. 3) in its axis direction, end cap members 67 are fixed as an example of a driving force transmitting member that rotationally drives the fixing belt 61 in its circumferential direction while maintaining the cross-sectional shape of the both ends of the fixing belt 61 in a circular shape. Then, the fixing belt 61 receives a rotational driving force through the end cap member 67 directly from the both ends of the fixing belt 61, and moves rotationally, for example, at a process speed of 140 mm/s in a direction of an arrow C in FIG. 3.

Figure 5A:
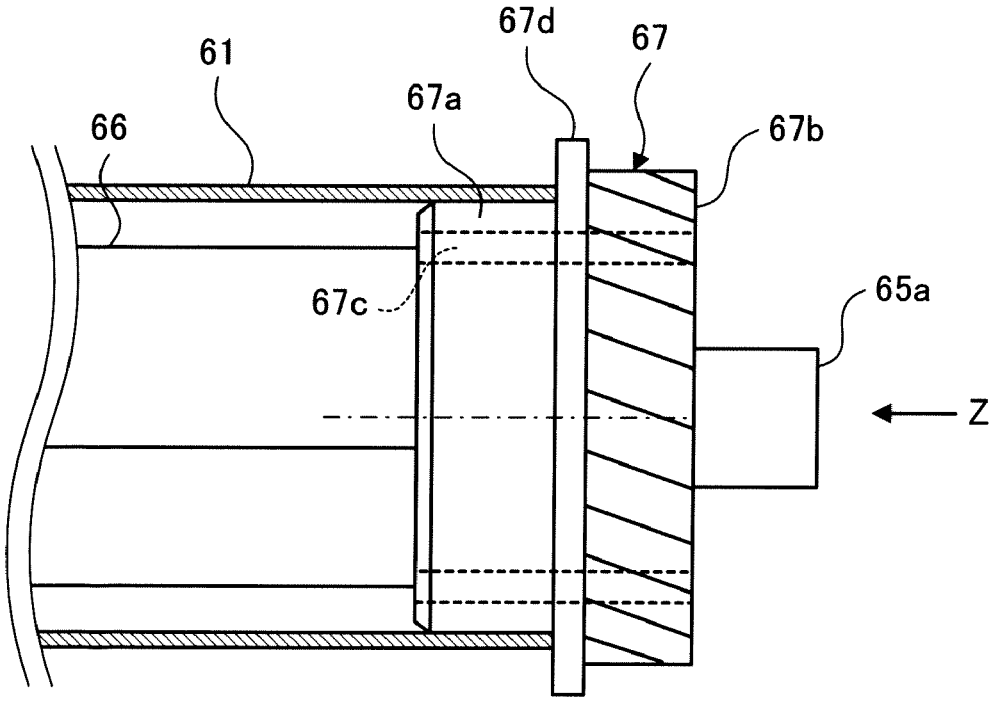
FIG. 5A is a lateral view of the end cap member.
Figure 5B:
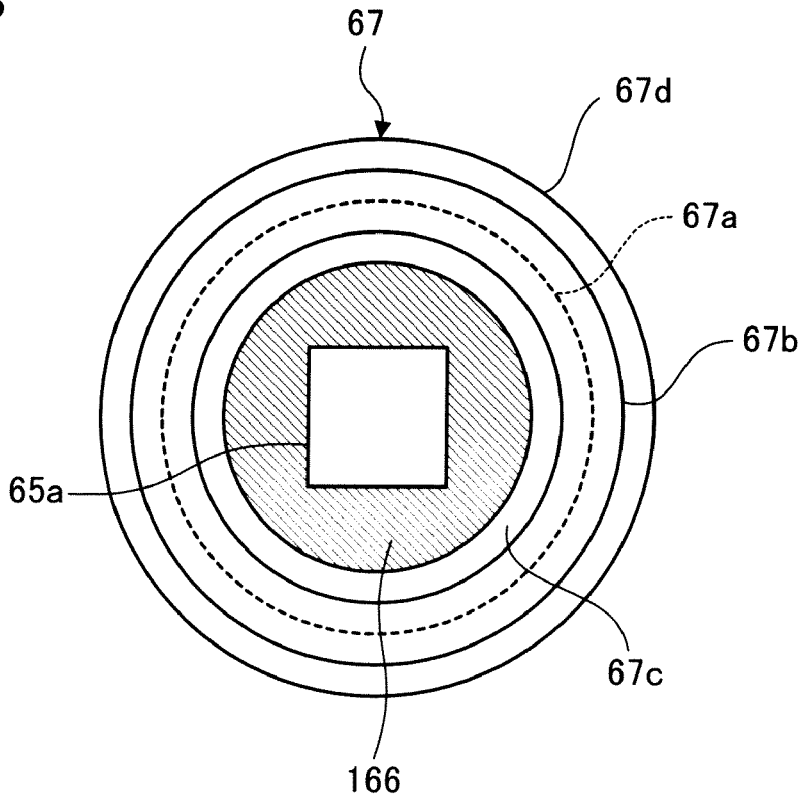
FIG. 5B is a plan view of the end cap member when seen from the Z direction shown in FIG. 5A.

FIG. 5A is a lateral view of the end cap member 67, and FIG. 5B is a plan view of the end cap member 67 when seen from the Z direction shown in FIG. 5A. As shown in FIGS. 5A and 5B, the end cap member 67 includes: a fixing portion 67*a* to be fit inside of the both ends of the fixing belt 61; a flange portion 67*d* formed to have an outer diameter larger than that of the fixing portion 67*a* and formed so as to extend in a radius direction more than the fixing belt 61 when attached to the fixing belt 61; a gear portion 67*b* to which a rotational driving force is transmitted; and a bearing portion 66*c* rotatably connected through a connecting member 166 to a supporting part 65*a* formed at both ends of the holder 65. Then, as shown in FIG. 2, when the supporting parts 65*a* at the both ends of the holder 65 are fixed to both ends of a chassis 69 of the fixing apparatus 60, the end cap member 67 is rotatably supported through the bearing portion 66*c* connected to the supporting part 65*a*.

As for a material constituting the end cap member 67, a so-called engineering plastic having high mechanical strength and high heat resistance is used. For example, a phenol resin, a polyimide resin, a polyamide resin, a polyamide-imide resin, a PEEK resin, a PES resin, a PPS resin, an LCP resin and the like are appropriate.

Here, as shown in FIG. 2, in the fixing apparatus 60, a rotational driving force from a driving motor 90 is transmitted to a shaft 93 via transmitting gears 91 and 92, and then transmitted from transmitting gears 94 and 95 connected to the shaft 93 to the gear portions 67*b* (refer to FIG. 5 described below) at the both end cap members 67. With such a configuration, a rotational driving force is transmitted from the end cap members 67 to the fixing belt 61, and then the end cap members 67 and the fixing belt 61 are rotationally driven integrally.

As described above, the fixing belt 61 is rotated when it receives a driving force directly from the both ends of the fixing belt 61; therefore, the fixing belt 61 rotates stably.

Here, in the case where the fixing belt 61 rotates when it receives a driving force directly from the end cap members 67 at the both ends of the fixing belt 61, in general, a torque in a range approximately from 0.1 N·m to 0.5 N·m is applied. However, in the case of the fixing belt 61 of the first exemplary embodiment, the base layer 611 is formed of, for example, an Fe—Ni alloy, having high mechanical strength. Thus, even when a torsional torque in a range approximately from 0.1 N·m to 0.5 N·m is applied to the whole fixing belt 61, buckling and the like are unlikely to occur in the fixing belt 61.

Meanwhile, the fixing belt 61 is prevented from sliding to one side by the flange portion 67*d* of the end cap member 67. To the fixing belt 61 in such a case, generally, a compression force in a range approximately from 1 N to 5 N is applied in the axis direction of the fixing belt 61 from the end (flange portion 67*d*) side. However, even when the fixing belt 61 receives such a compression force, the buckling and the like is prevented, since the base layer 611 of the fixing belt 61 is formed of an Fe—Ni alloy or the like.

As described above, the fixing belt 61 of the first exemplary embodiment rotates when it receives a driving force directly from the both ends of the fixing belt 61, thus enabling a stable rotation. Here, in this regard, a configuration in which buckling and the like due to torsional torque and a compression force are unlikely to occur is achieved by forming the base layer 611 of the fixing belt 61 with, for example, an Fe—Ni alloy having high mechanical strength. Furthermore, the base layer 611 and the conductive layer 612 are formed as a thin layer so as to secure plasticity and flexibility of the whole fixing belt 61. Thereby, deformation and shape recovery according to the nip part N are carried out.

Referring back to FIG. 3, the pressure roll 62 is arranged so as to face the fixing belt 61, and rotates in the direction of an arrow D in FIG. 3 at a process speed of, for example, 140 mm/s, by being driven by the fixing belt 61. Here, the nip part N is formed while the fixing belt 61 is sandwiched between the pressure roll 62 and the pressure pad 63. Then, while the paper sheet P holding an unfixed toner image is going through the nip part N, the unfixed toner image is fixed onto the paper sheet P by applying heat and pressure.

The pressure roll 62 is formed by stacking one another a solid-core iron core (cylindrical cored bar) 621 having, for example, a diameter of 18 mm, a heat-resistant elastic layer 622 made of, for example, silicone sponge or the like having a thickness of, for example, 5 mm coated on an outer peripheral surface of the core 621, and a releasing layer 623 formed by heat-resistant resin coating or heat-resistant rubber coating with, for example, PFA or the like having a thickness of 50 μm. Then, with the action of a pressure spring 68 (refer to FIG. 2), the pressure roll 62 applies a load of pressure of, for example, 20 kgf, to the pressure pad 63 through the fixing belt 61.

In the following section, the IH heater 80 for heating the conductive layer 612 of the fixing belt 61 by electromagnetic induction by an alternating-current magnetic field will be described.

Figure 6:
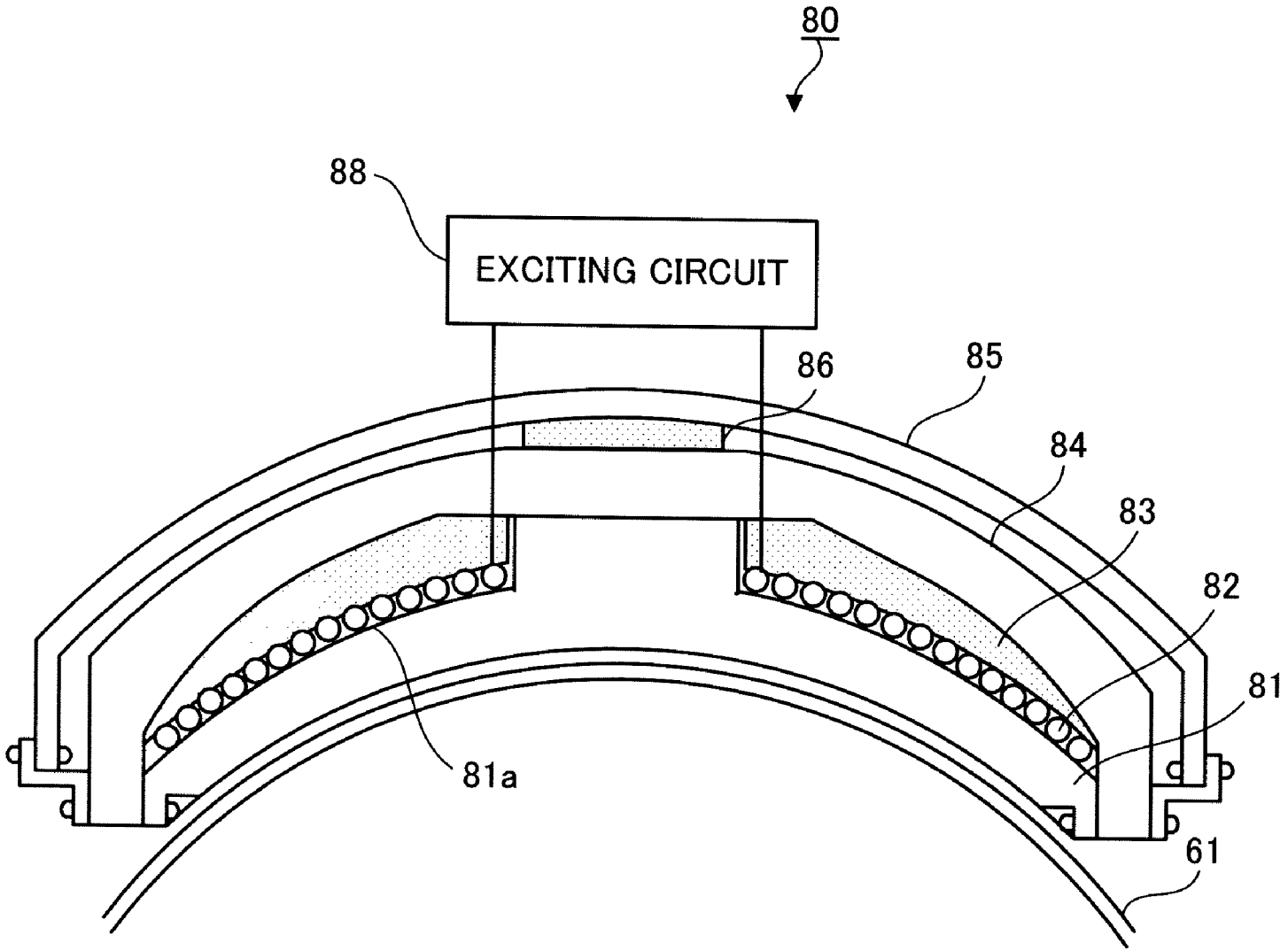
FIG. 6 is a cross-sectional view illustrating the configuration of the IH heater of the first exemplary embodiment.

FIG. 6 is a cross-sectional view illustrating the configuration of the IH heater 80 of the first exemplary embodiment. As illustrated in FIG. 6, the IH heater 80 includes: a supporting body 81 composed of a nonmagnetic body, such as a heat-resistant resin; an exciting coil 82 that generates an alternating-current magnetic field; an elastic supporting member 83 composed of an elastic body for fixing the exciting coil 82 onto the supporting body 81; a magnetic core 84 that forms a magnetic path of the alternating-current magnetic field generated by the exciting coil 82; a shield 85 that shields a magnetic field; a pressure member 86 that applies pressure to the magnetic core 84 towards the supporting body 81; and an exciting circuit 88 that supplies an alternating current to the exciting coil 82.

The supporting body 81 is formed so as to have a cross section curving along the surface shape of the fixing belt 61, and is formed so that a distance between an upper surface (supporting surface) 81*a* that supports the exciting coil 82 and the fixing belt 61 may be a predetermined value (for example, from 0.5 mm to 2 mm). As for a material constituting the supporting body 81, for example, a heat-resistant resin, such as heat-resistant glass, polycarbonate, polyethersulfone, polyphenylene sulfide (PPS), or a heat-resistant nonmagnetic material, such as a heat-resistant resin obtained by mixing the above-listed resin and glass fiber, is used.

The exciting coil 82 is formed by rolling a litz wire in a hollow closed loop format having an oval shape, an ellipsoidal shape, a rectangular shape, or the like. The litz wire is composed of, for example, 90 copper wire rods which are insulated from one another and each of which has a diameter of, for example, 0.17 mm, in a bundle. When an alternating current having a predetermined frequency is supplied from the exciting circuit 88 to the exciting coil 82, an alternating-current magnetic field having a center at the litz wire rolled in a closed loop format is generated around the exciting coil 82. The frequency of the alternating current supplied from the exciting circuit 88 to the exciting coil 82 is generally in a range from 20 kHz to 100 kHz.

For the magnetic core 84, a ferromagnetic body made of an oxide or an alloy material having high magnetic permeability, such as a soft ferrite, a ferrite resin, an amorphous alloy, a permalloy, and a magnetic shunt steel, is used, and the magnetic core 84 functions as a magnetic path forming unit. The magnetic core 84 forms a path of magnetic field lines (magnetic path) in which magnetic field lines (magnetic flux) from the alternating-current magnetic field generated by the exciting coil 82 goes from the exciting coil 82 across the fixing belt 61 towards the temperature-sensitive member 64, goes through the temperature-sensitive member 64, and goes back to the exciting coil 82. By forming a magnetic path by the magnetic core 84, the alternating-current magnetic field (magnetic field lines) generated by the exciting coil 82 is concentrated in a region of the fixing belt 61 facing the magnetic core 84. The magnetic core 84 may be made of a material having low loss due to the magnetic path formation. To be more specific, the magnetic core 84 may be used in a state in which eddy current loss is small (blocking or separation of an electric current path by a slit or the like, bundling of thin plates, and the like), and may be made of a material having low hysteresis loss.

In the following section, a description will be given of a state in which the fixing belt 61 is heated by the alternating-current magnetic field generated by the IH heater 80.

Firstly, as described above, the magnetic permeability change onset temperature of the base layer 611 of the fixing belt 61 and the temperature-sensitive member 64 is set in a temperature range (for example, from 140° C. to 240° C.) from not less than the heating preset temperature of the fixing belt 61, at which the color toner images are fixed, to not more than a heat proof temperature of the fixing belt 61. Here, in the case where the temperature of the fixing belt 61 is in a temperature range of the magnetic permeability change onset temperature and below, the base layer 611 and the temperature-sensitive member 64 exhibit ferromagnetism. Thus, magnetic field lines H of an alternating-current magnetic field generated by the IH heater 80 form a magnetic path which goes through the base layer 611 of the fixing belt 61 and the temperature-sensitive member 64 along a spreading direction. Here, the "spreading direction" refers to a direction orthogonal to a thickness direction.

Figure 7:
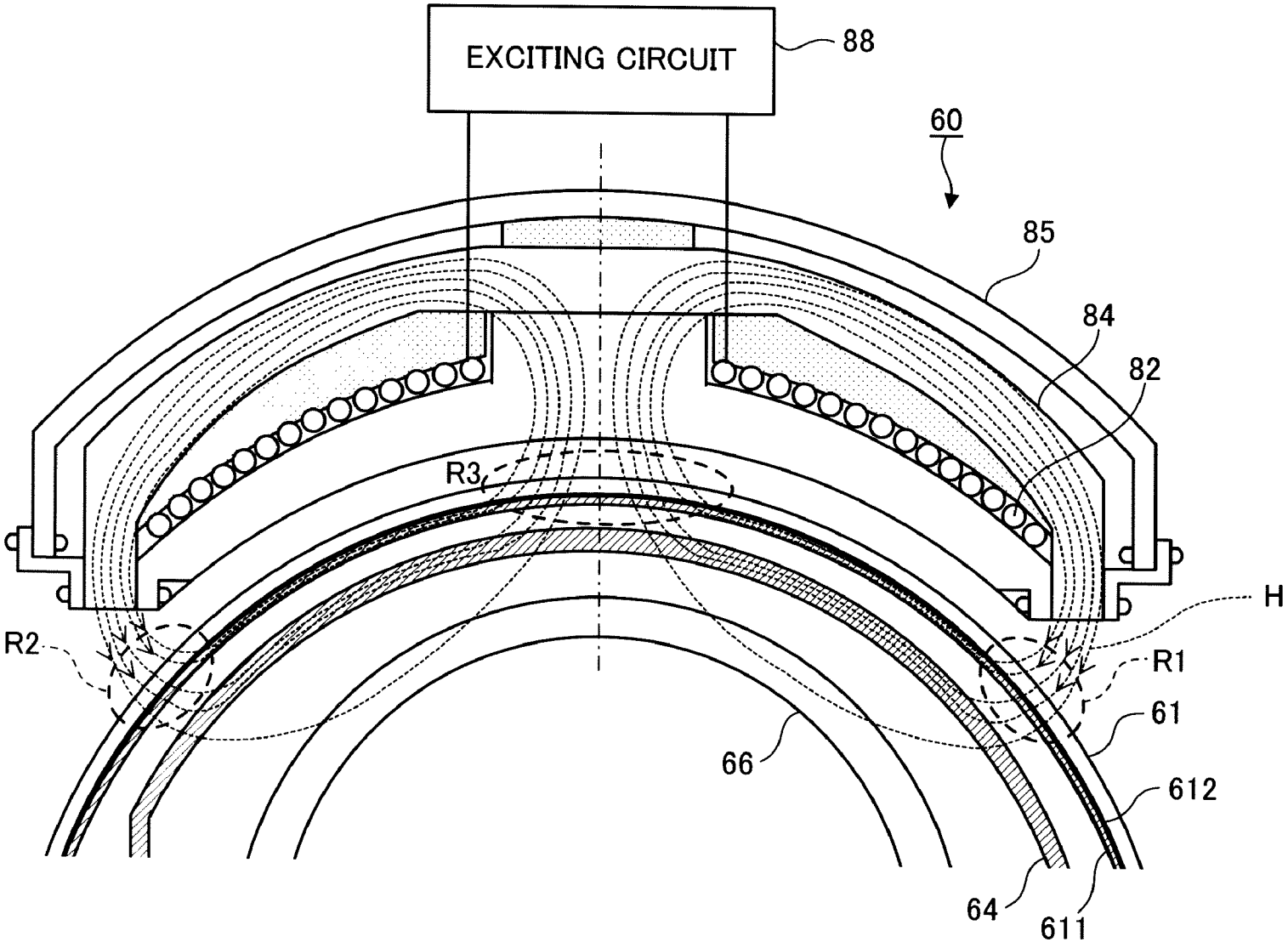
FIG. 7 is a view illustrating a state of the magnetic field lines in the case where the temperature of the fixing belt is in a temperature range of magnetic permeability change onset temperature and below.

FIG. 7 is a view illustrating a state of the magnetic field lines H in the case where the temperature of the fixing belt 61 is in a temperature range of magnetic permeability change onset temperature and below. As shown in FIG. 7, in the case where the temperature of the fixing belt 61 is in a temperature range of magnetic permeability change onset temperature and below, the magnetic field lines H of the alternating-current magnetic field generated by the IH heater 80 form a magnetic path which goes through the base layer 611 of the fixing belt 61 and the temperature-sensitive member 64 along the spreading direction (a direction orthogonal to the thickness direction). Consequently, a magnetic flux density of the magnetic field lines H going across the conductive layer 612 of the fixing belt 61 is high.

To be more specific, in regions R1 and R2 in which the magnetic field lines H emitted from the magnetic core 84 of the IH heater 80 go across the conductive layer 612 of the fixing belt 61, the magnetic field lines H are induced to the inside of the base layer 611 and the temperature-sensitive member 64. Accordingly, the magnetic field lines H going across the conductive layer 612 of the fixing belt 61 in the thickness direction are concentrated so as to enter the inside of the base layer 611 and the temperature-sensitive member 64. Consequently, the magnetic flux density in the regions R1 and R2 is high. Meanwhile, in a region R3 in which the magnetic field lines H having gone through the inside of the base layer 611 and the temperature-sensitive member 64 in the spreading direction go across the conductive layer 612 in the thickness direction when going back to the magnetic core 84, the magnetic field lines H are emitted from a position having a low magnetic potential inside the base layer 611 and the temperature-sensitive member 64 towards the magnetic core 84 in a concentrated manner. Accordingly, the magnetic field lines H going across the conductive layer 612 of the fixing belt 61 in the thickness direction go from a region of the base layer 611 and the temperature-sensitive member 64 towards the magnetic core 84 in a concentrated manner. As a result, the magnetic flux density in the region R3 is high.

In the conductive layer 612 of the fixing belt 61 in which the magnetic field lines H go across in the thickness direction, an eddy current I proportional to a change in the magnetic flux amount of the magnetic field lines H is generated. Thus, in the case where the temperature of the fixing belt 61 is in a temperature range of the magnetic permeability change onset temperature and below, the magnetic field lines H having a high magnetic flux density go through the regions R1, R2, and R3. Accordingly, a change in the magnetic flux amount is large, and a large eddy current I flows through the conductive layer 612. Thus, in the conductive layer 612, a Joule heat W ($W=I^2R$), which is a product of a specific resistant value R of the conductive layer 612 and the square of the eddy current I, is generated. Hence, in the case where the temperature of the fixing belt 61 is in a temperature range of the magnetic permeability change onset temperature and below, a large amount of heat is generated in the fixing belt 61.

As described above, in the fixing apparatus 60 of the first exemplary embodiment, both the base layer 611 that supports the conductive layer 612 serving as a heating layer of the fixing belt 61 and the temperature-sensitive member 64 arranged to be in non-contact with the inner peripheral surface of the fixing belt 61 function as a magnetic path forming unit that forms a magnetic path along the spreading direction (a direction orthogonal to the thickness direction) by inducing the magnetic field lines H generated by the IH heater 80, in the case where the temperature of the fixing belt 61 is in a temperature range of the magnetic permeability change onset temperature and below.

By the way, as described above, the fixing belt 61 is formed by stacking the conductive layer 612 made of Cu having a high electric conductivity formed by plating, deposition, or the like to have a thickness of approximately 10 μm on the base layer 611 composed of, for example, an Fe—Ni alloy having a thickness of 50 μm. To be more specific, by forming the base layer 611 of the fixing belt 61 as a thin layer made of, for example, an Fe—Ni alloy, having high mechanical strength, the fixing belt 61 is rotationally driven stably without any distortion, buckling, and the like in the fixing belt 61. Furthermore, plasticity and flexibility of the fixing belt 61 is enhanced so that the fixing belt 61 may deform according to the shape of the nip part N.

As described above, the base layer 611 of the fixing belt 61 is thinner than a skin depth (δ), which will be described below. Accordingly, in the case where the temperature of the fixing belt 61 is in a temperature range of the magnetic permeability change onset temperature and below and the base layer 611 exhibits ferromagnetism, a part of the magnetic field lines H generated by the IH heater 80 forms a magnetic path by being induced by the base layer 611 of the fixing belt 61, while the rest goes through the base layer 611 by cutting across in the layer thickness direction.

Thus, in the fixing apparatus 60 of the first exemplary embodiment, by arranging the temperature-sensitive member 64 on the inner peripheral surface side of the fixing belt 61, a magnetic path loop is formed in which the magnetic field lines H having gone through the base layer 611 by cutting across in the thickness direction return to the exciting coil 82 through the temperature-sensitive member 64. By having such a configuration, the magnetic flux density is increased. To be more specific, in the case where the temperature of the fixing belt 61 is in a temperature range of the magnetic permeability change onset temperature and below, a higher magnetic flux density and a higher magnetic coupling are achievable by a magnetic path forming unit composed of a ferromagnetic body as the magnetic path forming unit is located closer to the exciting coil 82. Accordingly, the formation of a magnetic path by the base layer 611 in the fixing belt 61 located close to the exciting coil 82 is effective, and formation of a magnetic path is also achievable with the temperature-sensitive member 64 located on the inner peripheral surface side of the fixing belt 61. As described above, in the fixing apparatus 60 of the first exemplary embodiment, the magnetic flux density is increased by two main magnetic path loops (a loop formed by the base layer 611 and a loop formed by the temperature-sensitive member 64).

Here, a layer thickness of the base layer 611 of the fixing belt 61 will be described. As described above, the base layer 611 of the fixing belt 61 is formed by, for example, an Fe—Ni—Cr alloy, from the viewpoint of securing mechanical strength of the fixing belt 61. Then, because of the need of enhancing plasticity and flexibility of the fixing belt 61, the base layer 611 is formed as a thin layer having a thickness of, for example, 50 μm. By the way, in general metal materials and the like, a main region to which the magnetic field lines H enter (attenuated to 1/e) is limited in an alternating-current magnetic field, and the region is used as an indicator for the determination of the thickness. This is called "skin depth" (δ) regarding the magnetic field lines H, and calculated by the following equation (1). In the equation (1), f represents a frequency of an alternating-current magnetic field (for example, 20 kHz), ρ represents a specific resistance value (Ω·m), and $\mu_r$ represents a relative magnetic permeability.

$$\delta = 503\sqrt{\frac{\rho}{f \cdot \mu_r}} \tag{1}$$

For example, in the case where a material having a specific resistant value ρ of $70\times10^{-8}$ Ω·m and a relative magnetic permeability $\mu_r$ of 400 is used as the base layer 611 of the fixing belt 61, when the frequency of the alternating-current magnetic field is set to 20 kHz, the skin depth (δ) of the base layer 611 is 149 μm according to the equation (1). Accordingly, when the base layer 611 of the fixing belt 61 is formed as a thin layer having a thickness of 50 μm from the viewpoint of enhancing plasticity and flexibility of the fixing belt 61 while securing mechanical strength thereof, the layer thickness of the base layer 611 is smaller than the skin depth (δ). Hence, as shown in the regions R1, R2, and R3, a part of the alternating-current magnetic field (magnetic field lines H) generated by the IH heater 80 forms a magnetic path by being induced by the base layer 611 of the fixing belt 61, while the rest goes through the base layer 611.

On the other hand, by arranging the temperature-sensitive member 64 on the inner peripheral surface side of the fixing belt 61, in the case where the temperature of the fixing belt 61 is a fixing temperature which is the magnetic permeability change onset temperature or below, as shown in FIG. 7, the rest of the magnetic field lines H having gone through the base layer 611 goes in a loop through the inside of the temperature-sensitive member 64 so that main magnetic flux may go back to the exciting coil 82. Such magnetic path formation makes it possible to enhance the magnetic coupling, to increase the magnetic flux density, to generate a large eddy current I in the conductive layer 612 of the fixing belt 61, and to generate a large amount of Joule heat W in the fixing belt 61.

Here, the temperature-sensitive member 64 of the first exemplary embodiment is arranged to be in non-contact with the inner peripheral surface of the fixing belt 61 so as to, at the start-up of the fixing apparatus 60, prevent heat from entering the temperature-sensitive member 64 from the fixing belt 61 having been heated by induction and to shorten a time required for heating the fixing belt 61 up to a fixable temperature.

Next, a description will be given of a mechanism for reducing the amount of heat generated in the fixing belt 61 by the alternating-current magnetic field generated by the IH heater 80.

Figure 8:
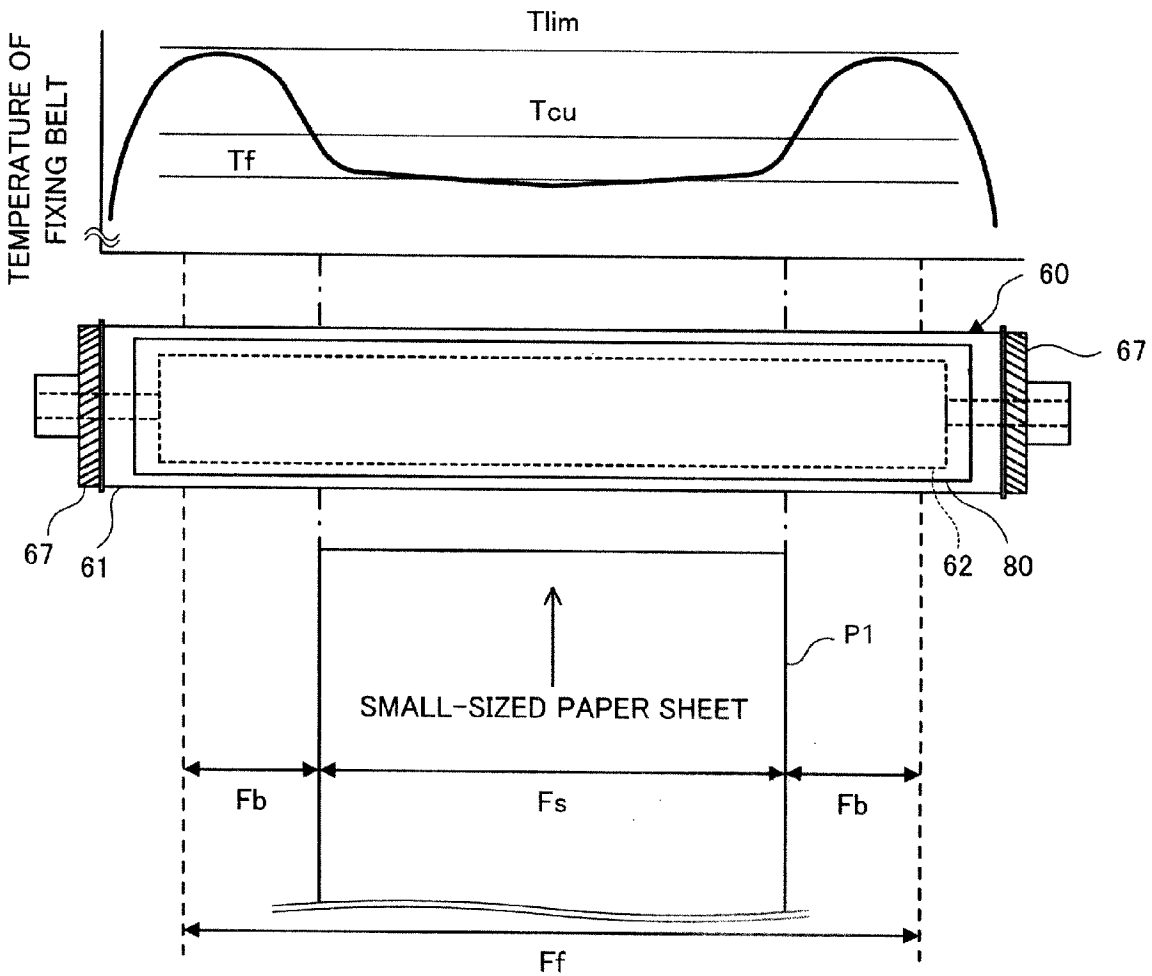
FIG. 8 is a drawing illustrating an outline of temperature distribution of the fixing belt when the small-sized paper sheet is continuously fed to the fixing belt.

Here, firstly, a description will be given of the case where a small-sized paper sheet P (small-sized paper sheet P1) is continuously fed to the fixing apparatus 60. FIG. 8 is a drawing illustrating an outline of temperature distribution of the fixing belt 61 when the small-sized paper sheet P1 is continuously fed thereto. In FIG. 8, a maximum paper sheet feeding region having a maximum size width (for example, the width of a A3 size) of the paper sheet P to be used in the image forming apparatus 1 is denoted as Ff, a region (small-sized paper sheet feeding region) in which the small-sized paper sheet P1 (for example, longitudinal feed of A4 size paper sheet) having a smaller width than that of a maximum size paper sheet P goes through is denoted as Fs, and a no-paper sheet fed region in which the small-sized paper sheet P1 does not go through is denoted as Fb. It should be noted that, in the image forming apparatus 1, paper feeding is carried out with reference to its center position.

As shown in FIG. 8, in the case where the small-sized paper sheet P1 is continuously fed, heat for fixing is consumed in the small-sized paper sheet feeding region Fs through which the small-sized paper sheet P1 passes. Accordingly, temperature adjustment control at a predetermined temperature is carried out by the controller 30 (refer to FIG. 1). By the control, the temperature of the fixing belt 61 in the small-sized paper sheet feeding region Fs is maintained to a predetermined value (heating preset temperature). In the meantime, in the no-paper sheet fed region Fb, temperature adjustment control similar to that in the small-sized paper sheet feeding region Fs is also carried out. However, no heat for fixing is consumed in the no-paper sheet fed region Fb. For this reason, the temperature of the no-paper sheet fed region Fb is raised to a temperature above the heating preset temperature of the fixing belt 61. If the small-sized paper sheet P1 is kept being fed continuously in such a state, the temperature of the no-paper sheet fed region Fb is raised to a temperature above, for example, the heatproof temperature of the elastic layer 613 and the surface releasing layer 614 of the fixing belt 61. As a result, the fixing belt 61 may be damaged.

Thus, as described above, in the fixing apparatus 60 of the first exemplary embodiment, the base layer 611 of the fixing belt 61 and the temperature-sensitive member 64 are composed of an Fe—Ni alloy or the like having a magnetic permeability change onset temperature set in a temperature range from not less than the heating preset temperature of the fixing belt 61 to, for example, not more than the heatproof temperature of the elastic layer 613 and the surface releasing layer 614 of the fixing belt 61. To be more specific, as shown in FIG. 8, a magnetic permeability change onset temperature Tcu of the base layer 611 of the fixing belt 61 and the temperature-sensitive member 64 is set in a range from not less than a heating preset temperature Tf of the fixing belt 61 to, for example, not more than a heatproof temperature Tlim of the elastic layer 613 and the surface releasing layer 614.

By having such a configuration, when the small-sized paper sheet P1 is continuously fed, the temperature in the no-paper sheet fed region Fb of the fixing belt 61 exceeds the magnetic permeability change onset temperature of the base layer 611 and the temperature-sensitive member 64. Accordingly, the relative magnetic permeability of the base layer 611 and the temperature-sensitive member 64 in the no-paper sheet fed region Fb of the fixing belt 61 comes close to 1. Consequently, two existing magnetic path forming units composed of a ferromagnetic body disappear. For this reason, when the relative magnetic permeability of the base layer 611 and the temperature-sensitive member 64 in the no-paper sheet fed region Fb of the fixing belt 61 decreases and is close to 1, the magnetic flux easily goes through the temperature-sensitive member 64 while the magnetic flux density of the magnetic field lines H going across the conductive layer 612 in the no-paper sheet fed region Fb in the fixing belt 61 decreases; therefore, the magnetic flux reaches the nonmagnetic metal inducing member 66 (refer to FIG. 3), and then is induced thereinto. Consequently, the eddy current I generated in the conductive layer 612 decreases, and the amount of heat (Joule heat W) generated in the fixing belt 61 is reduced. As a result, an excessive temperature rise in the no-paper sheet fed region Fb is prevented, and damage on the fixing belt 61 is prevented. When the magnetic flux reaches the nonmagnetic metal inducing member 66, a large amount of eddy current I flows into the nonmagnetic metal inducing member 66 which allows the eddy current I to flow therethrough more easily than the conductive layer 612. As a result, the amount of eddy current flowing into the conductive layer 612 is reducible.

At this time, the thickness, material, and shape of the nonmagnetic metal inducing member 66 are selected so as to shield most of the magnetic flux of the exciting coil 82. To be more specific, a material having a sufficient skin depth and the amount of heat generated therein as small as it may be even if the eddy current I flows thereinto is appropriate. In the first exemplary embodiment, a substantially circular-shaped aluminum having a thickness of 1 mm which fits along the temperature-sensitive member 64 is used so as to be in non-contact with the temperature-sensitive member 64 (an average distance therebetween is 4 mm). By arranging the material in non-contact, heat is unlikely to be drawn from the temperature-sensitive member 64. As for other material, Ag and Cu are suitable.

Here, if the temperature in the no-paper sheet fed region Fb in the fixing belt 61 falls below the magnetic permeability change onset temperature of the base layer 611 and the temperature-sensitive member 64, the base layer 611 and the temperature-sensitive member 64 again exhibit ferromagnetism, resulting in a large amount of eddy current I flowing into the conductive layer 612. Consequently, the fixing belt 61 is heated.

Figure 9:
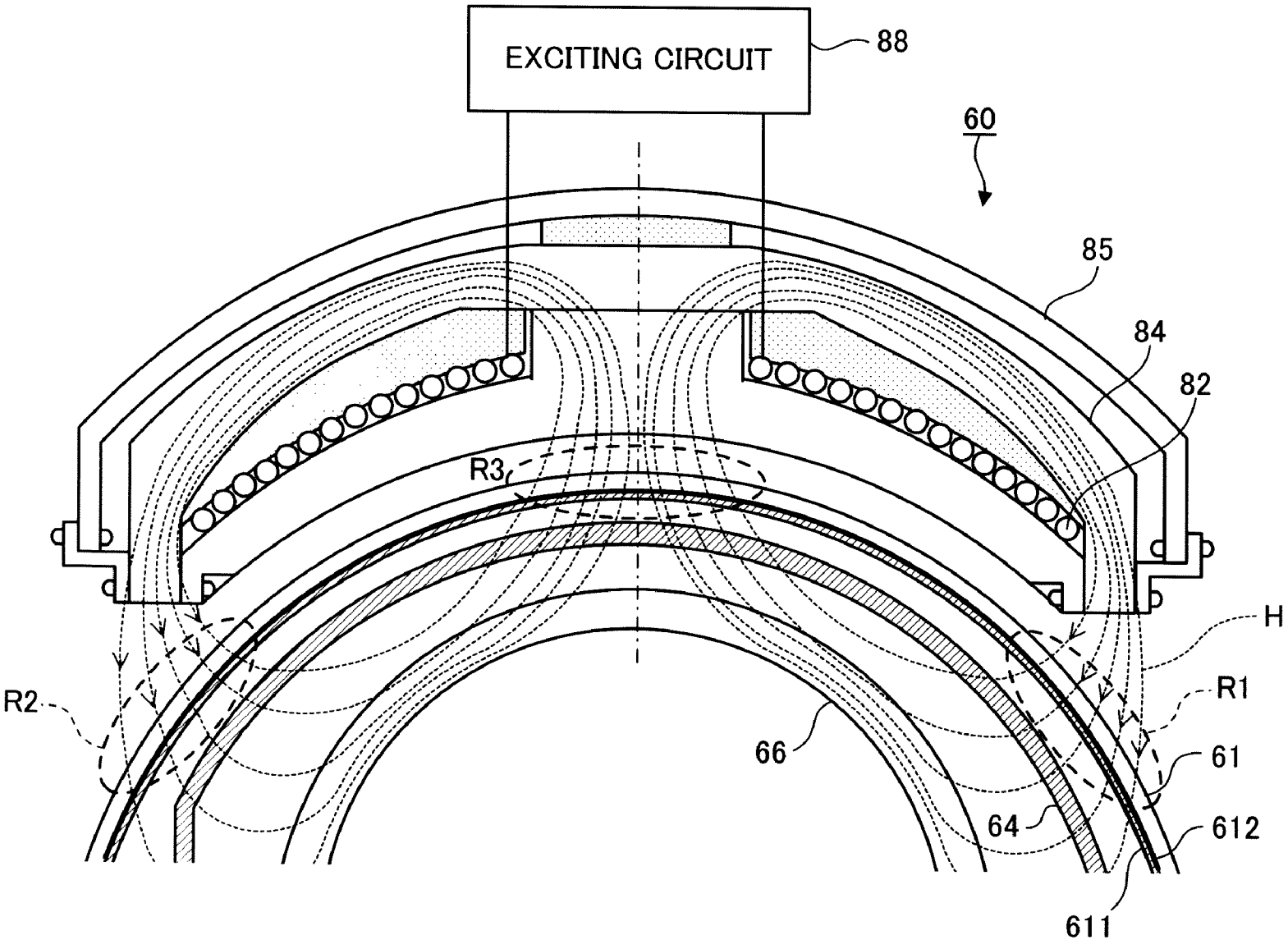
FIG. 9 is a view illustrating a state of the magnetic field lines in the case where the temperature of the fixing belt is in a temperature range above the magnetic permeability change onset temperature.

FIG. 9 is a view illustrating a state of the magnetic field lines H in the case where the temperature of the fixing belt 61 is in a temperature range above the magnetic permeability change onset temperature. As shown in FIG. 9, in the case where the temperature of the fixing belt 61 is in a temperature range above the magnetic permeability change onset temperature, the relative magnetic permeability of the base layer 611 and the temperature-sensitive member 64 decreases. Accordingly, the number of the magnetic field lines H of the alternating-current magnetic field generated by the IH heater 80 decreases and changes so as to easily penetrate the base layer 611 and the temperature-sensitive member 64. For this reason, the magnetic field lines H of the alternating-current magnetic field generated by the IH heater 80 are emitted so as to diffuse from the magnetic core 84 towards the inside of the fixing belt 61, and then reaches the nonmagnetic metal inducing member 66 and the holder 65.

As described above, in the case where the temperature of the fixing belt 61 is in a temperature range of the magnetic permeability change onset temperature and above, both the base layer 611 that supports the conductive layer 612 of the fixing belt 61 serving as a heat-generating layer and the temperature-sensitive member 64 arranged to be in non-contact with the inner peripheral surface of the fixing belt 61 lose a magnetic path forming unit facing the exciting coil 82, the number of the magnetic field lines H decreases, and the magnetic field lines H of the alternating-current magnetic field generated by the IH heater 80 form a magnetic path at a nonmagnetic metal inducing body.

In such a configuration, for example, in the no-paper sheet fed region Fb in which the temperature is raised due to continuous feeding of the small-sized paper sheet P1, the eddy current I generated in the conductive layer 612 of the fixing belt 61 is reduced, and then the amount of heat (Joule heat W) generated in the no-paper sheet fed region Fb of the fixing belt 61 is reduced. As a result, an excessive temperature rise in the no-paper sheet fed region Fb is prevented.

In accordance with the function of preventing an excessive temperature rise in the no-paper sheet fed region Fb regarding the base layer 611 and the temperature-sensitive member 64, the base layer 611 and the temperature-sensitive member 64 are caused to function as a magnetic path forming unit while configuring them so as to be unlikely to generate heat due to the magnetic field lines H. For this purpose, as a magnetic path forming unit, the base layer 611 and the temperature-sensitive member 64 are formed so that a total thickness of the base layer 611 and the temperature-sensitive member 64 may be at least larger than a sum of the skin depths ($\delta a+\delta b$) of the base layer 611 and the temperature-sensitive member 64 in a state where they exhibit ferromagnetism in a temperature range of the magnetic permeability change onset temperature and below. In other words, the material (specific resistance value and magnetic permeability) and thickness of the base layer 611 and the temperature-sensitive layer 64 are appropriately selected so as to prevent a main magnetic flux {(1−1/e×100) % or above} from the exciting coil 82 from penetrating the temperature-sensitive member 64.

Here, in the temperature-sensitive member 64, multiple slits are formed which divide the flow of the eddy current I generated by the magnetic field lines H.

By having such a configuration, the amount of self-heating of the temperature-sensitive member 64 is reduced; therefore, in the case where an excessive temperature rise occurs in the no-paper sheet fed region Fb, when the temperature-sensitive member 64 is heated to a temperature above the magnetic permeability change onset temperature, the temperature of the temperature-sensitive member 64 itself is maintained low. Furthermore, the base layer 611 of the fixing belt 61 and the temperature-sensitive member 64 change to exhibit paramagnetism. Accordingly, when the amount of heat generated in the no-paper sheet fed region Fb of the fixing belt 61 is reduced, a temperature difference between the paper sheet feeding region Fs and the no-paper sheet fed region Fb becomes small, if the temperature of the temperature-sensitive member 64 itself is excessively raised to reach a temperature close to the magnetic permeability change onset temperature. However, by reducing the amount of self-heating of the temperature-sensitive member 64, the effect of preventing a temperature rise in the non-paper sheet feeding part of the fixing belt 61 is prevented from being deteriorated.

Here, a description will be given of the thickness of the base layer 611 of the fixing belt 61 and the thickness of the temperature-sensitive member 64.

The same Fe—Ni alloy is used for the temperature-sensitive member 64 and the base layer 611 of the fixing belt 61. When the Fe—Ni alloy is a material having a specific resistance value $\rho$ of $70\times10^{-8}$ Ω·m and a relative magnetic permeability $\mu_r$ of 400 at room temperature in a state where they exhibit ferromagnetism and the frequency of the alternating-current magnetic field is set to 20 kHz, the skin depth ($\delta$) in a state where they exhibit ferromagnetism is 149 μm according to the equation (1). Meanwhile, when the specific resistant value $\rho$ of the Fe—Ni alloy in a state where it exhibits paramagnetism is considered to stay unchanged from that at room temperature although the value slightly increases by a temperature coefficient, since the relative magnetic permeability $\mu_r$ changes to 1, the skin depth ($\delta$) in a state where they fully exhibit paramagnetism is 2978 μm according to the equation (1).

In such a case, when the base layer 611 and the temperature-sensitive member 64 are formed so that at least a total thickness of the base layer 611 and the temperature-sensitive member 64 may be larger than the skin depth ($\delta$) of 149 μm in a state where they exhibit ferromagnetism, the magnetic field lines H of the alternating-current magnetic field generated by the IH heater 80 form a magnetic path of (1−1/e×100) % or above in a state where the base layer 611 and the temperature-sensitive member 64 exhibit ferromagnetism.

When the magnetic field lines H act on the temperature-sensitive member 64, the eddy current I is generated in the temperature-sensitive member 64. For example, in the case where the temperature-sensitive member 64 is formed to have a small thickness, an electric resistance R of the temperature-sensitive member 64 is large. Accordingly, the eddy current I in the temperature-sensitive member 64 tends to be smaller, and the amount of heat generated in the temperature-sensitive member 64 tends to be smaller.

The Joule heat W generated in the temperature-sensitive member 64 due to eddy current loss is expressed by $W=I^2R$ as described above, and the square of the eddy current I is involved in the Joule heat W. Thus, by either increasing the electric resistance R of the temperature-sensitive member 64 or reducing the eddy current I, the amount of heat generated in the temperature-sensitive member 64 is decreased.

The electric resistance R of the temperature-sensitive member 64 is calculated by the following equation (2). In the equation (2), ρ represents a specific resistance value (Ω·m) of the temperature-sensitive member 64, S represents a cross-sectional area of the temperature-sensitive member 64, and L represents a path length of the eddy current I flowing in the temperature-sensitive member 64. According to the equation (2), in the case where the temperature-sensitive member 64 is formed to have a smaller thickness, the cross-sectional area S of the temperature-sensitive member 64 is reduced, and the electric resistance R of the temperature-sensitive member 64 is increased.

$$R = \rho \frac{L}{S} \tag{2}$$

When the thickness of the temperature-sensitive member 64 is denoted as T0, a magnetic flux penetration depth in a state where the temperature-sensitive member 64 exhibits ferromagnetism is denoted as T1, and the skin depth in a state where the temperature-sensitive member 64 exhibits paramagnetism is denoted as T2, the eddy current I flowing in a part (T0−T1) is small if T0>T1. However, when the state changes to a state where the temperature-sensitive member 64 exhibits paramagnetism, the thickness in which a thin electric current flows is T0. Accordingly, the thickness region in which the eddy current I flows is increased. Thus, in the state where the temperature-sensitive member 64 exhibits paramagnetism, according to the equation (2), the cross-sectional area S of the temperature-sensitive member 64 is increased, and the electric resistance R of the temperature-sensitive member 64 having a high specific resistance is decreased. Consequently, heat is more easily generated.

Thus, in the temperature-sensitive member 64, while the thickness of a region in which the eddy current I flows may be reduced by making the magnetic flux penetration depth T1 in a state where the temperature-sensitive member 64 exhibits ferromagnetism as small as it may be so as to achieve a high electric resistance R, the electric resistance R in a state where the temperature-sensitive member 64 exhibits paramagnetism may be increased.

Next, in the case where the thickness of the temperature-sensitive member 64 is T0<T1, when the eddy current I flows into the entire thickness T0, the smallest electric resistance R of the temperature-sensitive member 64 is achieved. In this case, both the thickness region in which the eddy current I flows in a state where the temperature-sensitive member 64 exhibits ferromagnetism and the thickness region in which the eddy current I flows in a state where the temperature-sensitive member 64 changes to exhibit paramagnetism are T0. Thus, when the thickness of the temperature-sensitive member 64 is T0<T1, the amount of generated heat is reduced in accordance with a difference between the thickness of the temperature-sensitive member 64 and the skin depth.

In other words, in the case where the thickness of the temperature-sensitive member 64 is set to T0<T1, as for the Joule heat W ($W=I^2R$) generated in the temperature-sensitive member 64, while the electric resistance R of the temperature-sensitive member 64 is reduced, the eddy current I is also reduced. As a result, the amount of heat generated in the temperature-sensitive member 64 is minimized.

It should be noted that the first exemplary embodiment is on the assumption that a magnetic path is formed by most of the magnetic flux leaked from the magnetic path of the base layer 611 in the temperature-sensitive member 64.

When the magnetic flux penetration depth T1 is made as small as it may be and the electric resistance R is increased, Joule heat generation in a state where the temperature-sensitive member 64 exhibits ferromagnetism is preventable. Meanwhile, when the electric resistance R in a state where the temperature-sensitive member 64 exhibits paramagnetism (skin depth T2) is increased, self heating of the temperature-sensitive member 64 due to the eddy current I is preventable.

In order to reduce the magnetic flux penetration depth T1 and increase the electric resistance R, it is necessary to increase a relative magnetic permeability. When the relative magnetic permeability is high, a higher magnetic coupling and a higher magnetic flux density are achieved, which are also desirable for a magnetic path forming unit. A high relative magnetic permeability is achievable by heat treatment of the temperature-sensitive member 64 followed by full annealing.

Figure 10:
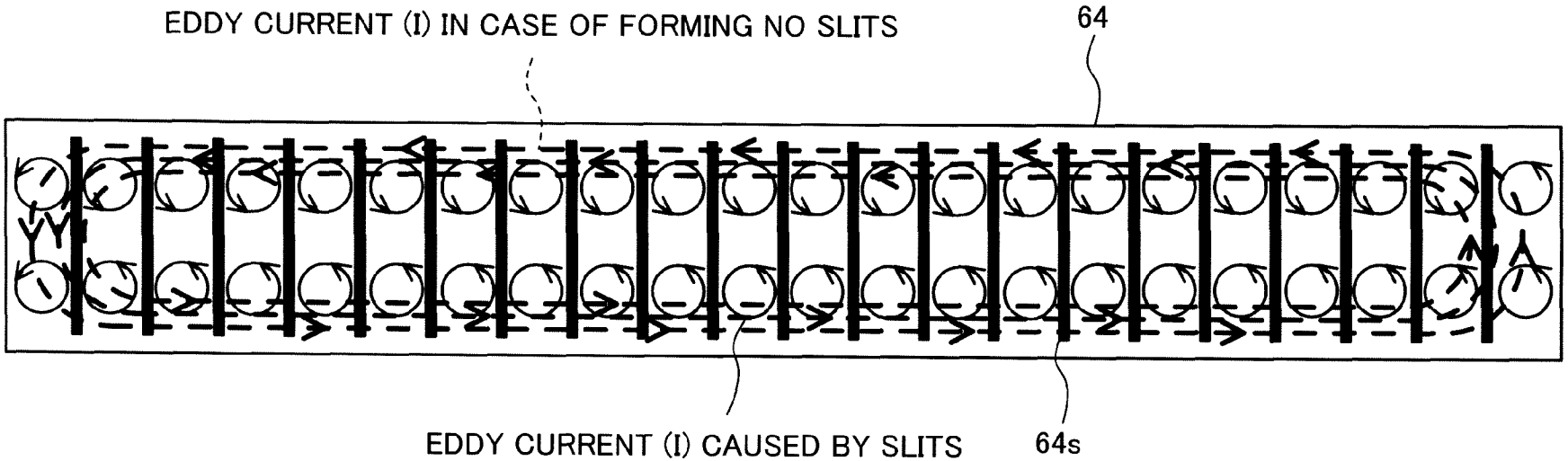
FIG. 10 is a drawing illustrating slits formed in the temperature-sensitive member.

Next, a description will be given of a slit formed in the temperature-sensitive member 64 so as to reduce the electric resistance R in a state where the temperature-sensitive member 64 exhibits paramagnetism (skin depth T2). FIG. 10 is a drawing illustrating slits formed in the temperature-sensitive member 64. As shown in FIG. 10, in the temperature-sensitive member 64, multiple slits 64*s* are formed so as to be orthogonal to a flowing direction of the eddy current I generated by the magnetic field lines H. Accordingly, the eddy current I (a broken line in the drawing), which flows in a large swirl through the entire temperature-sensitive member 64 in its longitudinal direction when the slits 64*s* are not formed, is divided by the slits 64*s*. Thereby, when the slits 64*s* are formed, the eddy current I (a solid line in the drawing) flowing inside of the temperature-sensitive member 64 makes a small swirl in each region between the neighboring slits 64*s*. Thus, the amount of the eddy current I is reduced as a whole. As a result, the amount of heat generated in the temperature-sensitive member 64 is reduced, and then a configuration in which heat generation is unlikely to occur is achieved. Hence, the multiple slits 64*s* function as an eddy current dividing part for dividing the eddy current I.

Here, in the example of the temperature-sensitive member 64 illustrated in FIG. 10, the slits 64*s* are formed so as to be orthogonal to the flowing direction of the eddy current I. However, slits which are oblique to the flowing direction of the eddy current I, for example, may be formed as long as a configuration in which the flow of the eddy current I is divided is achieved. Furthermore, instead of the configuration in which the slits 64*s* are formed throughout the entire region of the temperature-sensitive member 64 in its width direction, as illustrated in FIG. 10, the slits 64*s* may be formed in a part of the temperature-sensitive member 64 in its width direction. Moreover, in accordance with the amount of heat generated in the temperature-sensitive member 64, the number, position, obliquity angle of the slits and the like may be set accordingly.

Furthermore, as a state where the obliquity angle of the slits is largest, the temperature-sensitive member 64 may be a group of small divided pieces where the temperature-sensitive member 64 is divided into small pieces by slit portions. Even in such a configuration, the effect of the present invention is similarly obtainable.

As described above, the temperature-sensitive member 64 of the first exemplary embodiment is formed to be thinner than the skin depth δ in a state where it exhibits ferromagnetism in a temperature range of the magnetic permeability change onset temperature and below, and the multiple slits 64*s* which divide the flow of the eddy current I are formed in the temperature-sensitive member 64. By having such a configuration, a configuration in which heat is unlikely to be generated by the magnetic field lines H is achievable. Thus, even if an excessive temperature rise occurs in the no-paper sheet fed region Fb and the temperature-sensitive member 64 changes from ferromagnetic to paramagnetic, the temperature-sensitive member 64 itself stays in a low temperature condition.

Next, a description will be given of the magnetic permeability change onset temperature set for the temperature-sensitive member 64. As described above, the magnetic permeability change onset temperature of the temperature-sensitive member 64 is set in a temperature range from not less than the heating preset temperature of the fixing belt 61, at which each color toner image melts, to the temperature lower than the heatproof temperature of the elastic layer 613 and the surface releasing layer 614 of the fixing belt 61. In doing so, the magnetic permeability change onset temperature set for the temperature-sensitive member 64 may be set to be lower than the magnetic permeability change onset temperature set for the base layer 611 of the fixing belt 61.

To be more specific, the temperature-sensitive member 64 is arranged to be in non-contact with the inner peripheral surface of the fixing belt 61. Accordingly, for example, even in the case where the small-sized paper sheet P1 is continuously fed and the temperature of the no-paper sheet fed region Fb is raised, the temperature in a region, in the temperature-sensitive member 64, facing the no-paper sheet fed region Fb is raised later than that in the fixing belt 61. Then, in order to make the temperature in the region in the temperature-sensitive member 64 correspond to that in the fixing belt 61, the magnetic permeability change onset temperature set for the temperature-sensitive member 64 is set to be lower than the magnetic permeability change onset temperature set for the base layer 611 of the fixing belt 61. Thereby, the timing of the base layer 611 of the fixing belt 61 reaching its magnetic permeability change onset temperature and the timing of the temperature-sensitive member 64 reaching its magnetic permeability change onset temperature are roughly in accordance with each other. As a result, an excessive temperature rise in the no-paper sheet fed region Fb is effectively preventable.

However, if the magnetic permeability change onset temperature of the temperature-sensitive member 64 is set to be too low, a phenomenon is observed in which a saturate magnetic flux density is lowered in the temperature-sensitive member 64. Accordingly, in the case where the magnetic permeability change onset temperature of the temperature-sensitive member 64 is set to be too low, the amount of magnetic flux going through the temperature-sensitive member 64 is increased even in a state where the temperature-sensitive member 64 exhibits ferromagnetism before reaching its magnetic permeability change onset temperature. As a result, even when the temperature-sensitive member 64 exhibits paramagnetism after reaching its magnetic permeability change onset temperature, a difference is small between the amounts of magnetic flux going through the temperature-sensitive member 64 in a state where the temperature-sensitive member 64 exhibits ferromagnetism and in a state where the temperature-sensitive member 64 exhibits paramagnetism. Accordingly, an effect of lowering the temperature in the no-paper sheet fed region Fb is reduced. For this reason, the magnetic permeability change onset temperature of the temperature-sensitive member 64 is set within a range where influence of a reduction in the saturated magnetic flux density is small.

As described above, in the fixing apparatus 60 of the first exemplary embodiment, the base layer 611 of the fixing belt 61 is constituted as a magnetic path forming unit that forms a magnetic path of an alternating-current magnetic field generated by the IH heater 80 while serving as a base member providing mechanical strength of the fixing belt 61. Meanwhile, the temperature-sensitive member 64 is spaced from the inner peripheral surface of the fixing belt 61 by a predetermined distance so as not to be in contact with the inner peripheral surface thereof, and is constituted as a magnetic path forming unit that forms a magnetic path of an alternating-current magnetic field generated by the IH heater 80. Then, the base layer 611 of the fixing belt 61 and the temperature-sensitive member 64 are made of a material having a magnetic permeability change onset temperature set in a temperature range from not less than a heating preset temperature of the fixing belt 61, at which each color toner image melts, to not more than a heatproof temperature of the elastic layer 613 and the surface releasing layer 614 of the fixing belt 61.

By having such a configuration, in the case where the temperature of the fixing belt 61 is in a temperature range of the magnetic permeability change onset temperature and below, a large amount of heat is generated in the fixing belt 61. On the contrary, in the case where the temperature of the fixing belt 61 is in a temperature range of the magnetic permeability change onset temperature and above, the amount of heat generated in the fixing belt 61 is reduced, and an excessive temperature rise in the no-paper sheet fed region Fb is prevented. In addition, mechanical strength, plasticity, and flexibility of the fixing belt 61 are secured. Accordingly, stable rotation is achievable in a configuration in which the fixing belt 61 is rotated by directly receiving a driving force.

Second Exemplary Embodiment

In the first exemplary embodiment, a configuration in which the temperature-sensitive member 64 is arranged to be in non-contact with the inner peripheral surface of the fixing belt 61 has been described. In the second exemplary embodiment, a configuration in which the temperature-sensitive member 64 is arranged in contact with the inner peripheral surface of the fixing belt 61 will be described. Here, similar configurations to those in the first exemplary embodiment are denoted by the same reference numerals, and detailed description thereof will be omitted.

Figure 11:
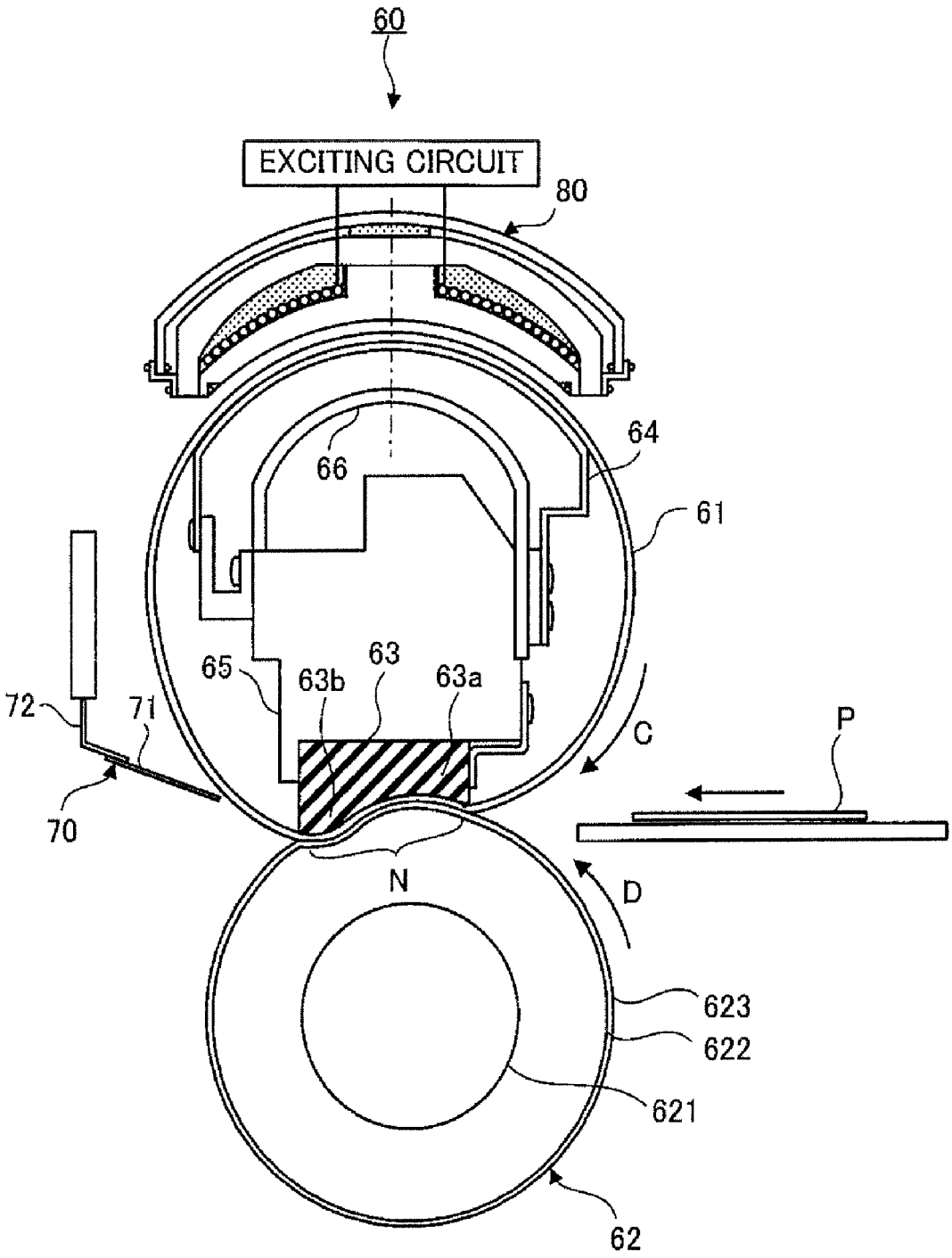
FIG. 11 is a cross-sectional view illustrating a configuration of a fixing apparatus of the second exemplary embodiment.

FIG. 11 is a cross-sectional view illustrating a configuration of a fixing apparatus 60 of the second exemplary embodiment. In the fixing apparatus 60 of the second exemplary embodiment, as shown in FIG. 11, the thickness of a temperature-sensitive member 64 is changed to be in a range from 300 μm to 500 μm, and the temperature-sensitive member 64 is arranged in contact with the inner peripheral surface of a fixing belt 61. Other configurations are constituted similarly to those in the fixing apparatus 60 of the first exemplary embodiment, shown in FIG. 3.

The fixing apparatus 60 of the second exemplary embodiment is configured so that the temperature-sensitive member 64 may also function as a heat-generating body. By having such a configuration, the temperature-sensitive member 64 supports heat generation in a conductive layer 612 of the fixing belt 61 and functions so as to prevent a drop in the temperature of the fixing belt 61 in the case where a high-speed operation (highly-productive operation) is carried out.

To be more specific, the temperature-sensitive member 64 in the first exemplary embodiment described above is arranged to be in non-contact with the inner peripheral surface of the fixing belt 61 so as to prevent heat from flowing from the fixing belt 61 heated by induction into the temperature-sensitive member 64 and to shorten a time required for start-up, at the start-up of the fixing apparatus 60. On the contrary, the temperature-sensitive member 64 of the second exemplary embodiment, although it allows heat to flow into the temperature-sensitive member 64 at start-up of the fixing apparatus 60, is caused to function in the fixing apparatus 60 in which the fixing belt 61 having a small heat capacity is used as a heat-generating member so that the temperature-sensitive member 64 may support heat generation in the conductive layer 612 of the fixing belt 61 in order to maintain a heating preset temperature during fixing operation and to prevent a phenomenon (so-called "temperature droop phenomenon") in which the temperature of the fixing belt 61 drops at the initiation of a high-speed fixing operation.

Figure 12:
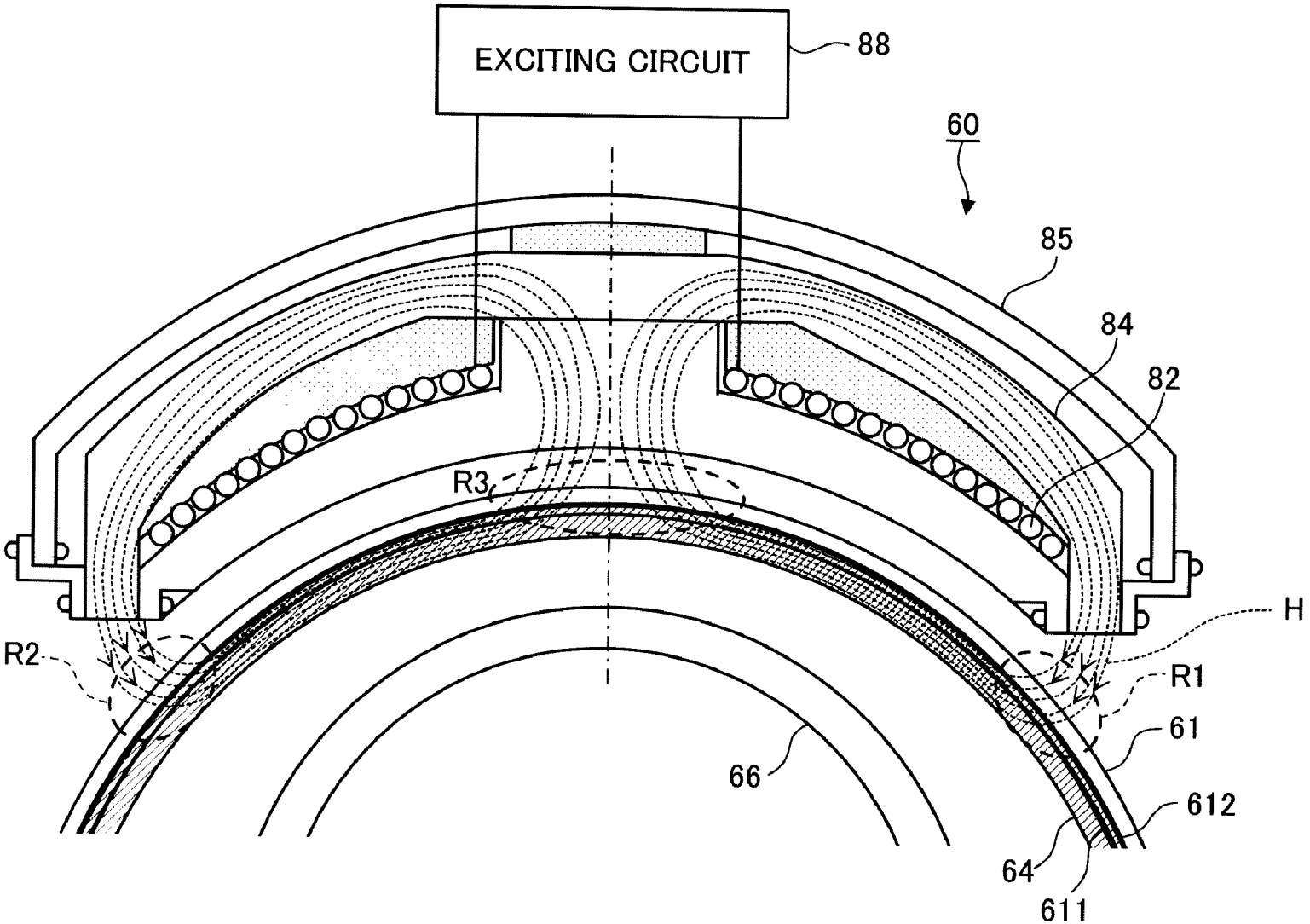
FIG. 12 is a view illustrating a state of the magnetic field lines in the case where the temperature of the fixing belt is in a temperature range of magnetic permeability change onset temperature and below in the fixing apparatus of the second exemplary embodiment.

FIG. 12 is a view illustrating a state of the magnetic field lines H in the case where the temperature of the fixing belt 61 is in a temperature range of magnetic permeability change onset temperature and below in the fixing apparatus 60 of the second exemplary embodiment. As shown in FIG. 12, in the case where the temperature of the fixing belt 61 is in a temperature range of magnetic permeability change onset temperature and below, the magnetic field lines H of the alternating-current magnetic field generated by the IH heater 80 form a magnetic path which goes through the base layer 611 of the fixing belt 61 and the temperature-sensitive member 64 along the spreading direction (a direction orthogonal to the thickness direction). By this configuration, the magnetic coupling and magnetic flux density are increased. Accordingly, in the conductive layer 612 of the fixing belt 61, a state in which a large amount of heat is easily generated is achievable.

Furthermore, in the second exemplary embodiment, the thickness of the temperature-sensitive member 64 is set to 300 μm or above, and no slit is implemented which completely divides the path of the eddy current I flowing in the temperature-sensitive member 64. Accordingly, although the temperature-sensitive member 64 generates a smaller amount of heat than the conductive layer 612, it generates heat more easily than that in the first exemplary embodiment described above.

To be more specific, in the case where the temperature of the fixing belt 61 is in a temperature range of the magnetic permeability change onset temperature and below, when a base layer 611 of the fixing belt 61 and the temperature-sensitive member 64 are made of, for example, an Fe—Ni alloy (relative magnetic permeability $\mu_r$ of 400), in regions R1, R2 and R3 in which the magnetic field lines H emitted from a magnetic core 84 of an IH heater 80 go across the conductive layer 612 of the fixing belt 61 in the thickness direction, the magnetic field lines H are concentrated so as to enter the inside of the base layer 611 and the temperature-sensitive layer 64, and the magnetic flux is mainly divided into two loops: one is formed by the base layer 611 and the other is formed by the temperature-sensitive member 64. With the two magnetic path loops, in the case where the temperature of the fixing belt 61 is in a temperature range of the magnetic permeability change onset temperature and below, generation of a large amount of heat in the fixing belt 61 is achievable.

In this case, the thickness of the temperature-sensitive member 64 is set to be larger than the skin depth (δ) of 149 μm in a state where the temperature-sensitive member 64 exhibits ferromagnetism. Thereby, in the case where the temperature of the fixing belt 61 is in a temperature range of the magnetic permeability change onset temperature and below, most of the magnetic field lines H of the alternating-current magnetic field generated by the IH heater 80 form a magnetic path in the temperature-sensitive member 64. Consequently, the number of the magnetic field lines H going across the temperature-sensitive member 64 in the thickness direction is reduced. However, since the thickness of the temperature-sensitive member 64 is as large as, for example, 149 μm or larger, according to the above equation (2), the electric resistance R of the temperature-sensitive member 64 is small. Hence, the eddy current I generated in the temperature-sensitive member 64 is increased, whereby the amount of heat generated in the temperature-sensitive member 64 is increased.

Meanwhile, by setting the thickness of the temperature-sensitive member 64 to be larger than 149 μm which is the skin depth (δ) in a state where the temperature-sensitive member 64 exhibits ferromagnetism, heat capacity of the temperature-sensitive member 64 is increased. Thus, a certain amount of heat is accumulated in the temperature-sensitive member 64.

As described above, the temperature-sensitive member 64 itself generates heat, and heat accumulation therein is also achievable due to the increased thickness. Accordingly, when the temperature of the fixing belt 61 drops, heat is supplied from the temperature-sensitive member 64 to the fixing belt 61. Thereby, the fixing belt 61 is maintained at a heating preset temperature, and the temperature droop phenomenon in which the temperature of the fixing belt 61 drops at the initiation of a high-speed fixing operation is prevented.

Figure 13A:
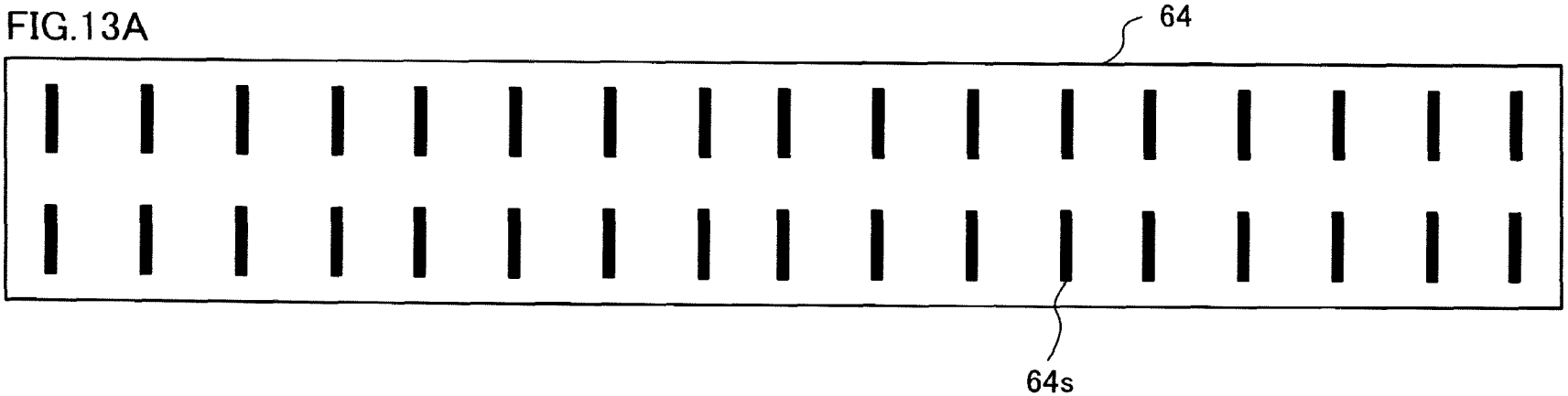
FIGS. 13A and 13B illustrate examples of slits formed so as not to completely divide the path of the eddy current.
Figure 13B:
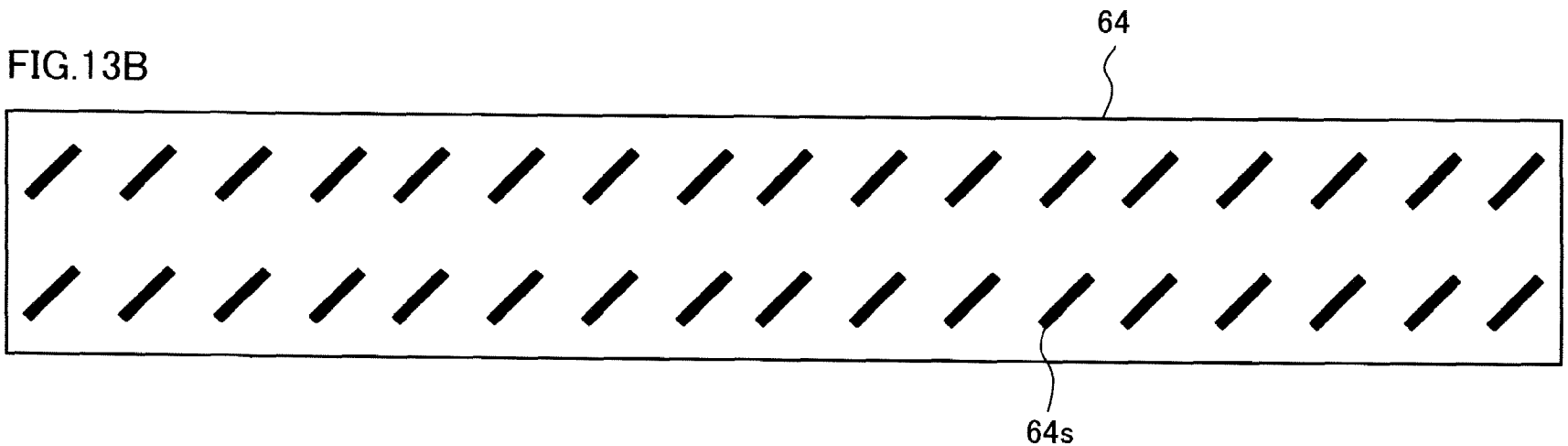

Here, since the temperature-sensitive member 64 of the second exemplary embodiment is configured so as to generate heat, the slit 64*s* (refer to FIG. 10) of the first exemplary embodiment is not basically required to be provided. However, if the amount of heat generated by the temperature-sensitive member 64 is to be adjusted accordingly, the slit 64*s* may be provided. In such a case, a slit may be formed so as not to completely divide a path of the eddy current I. Here, FIGS. 13A and 13B illustrate examples of slits formed so as not to completely divide the path of the eddy current I. As shown in FIGS. 13A and 13B, multiple slits 64*s* formed in the temperature-sensitive member 64 so as not to completely divide the path of the eddy current I are formed separately so as not to completely block the temperature-sensitive member 64 in its lateral direction. In this case, a configuration, as shown in FIG. 13A, in which the slits 64*s* are formed orthogonal to the longitudinal direction of the temperature-sensitive member 64, a configuration, as shown in FIG. 13B, in which slits 64*s* are formed so as to be tilted at a 45 degrees angle with respect to the longitudinal direction of the temperature-sensitive member 64, or the like may be employed.

In the meantime, when the thickness of the temperature-sensitive member 64 is set to be 149 μm, which is the skin depth (δ) in a state where the temperature-sensitive member 64 exhibits ferromagnetism, or smaller, as described in the first exemplary embodiment, the amount of heat generated in the temperature-sensitive member 64 is reduced by the amount of the reduced thickness.

Figure 14:
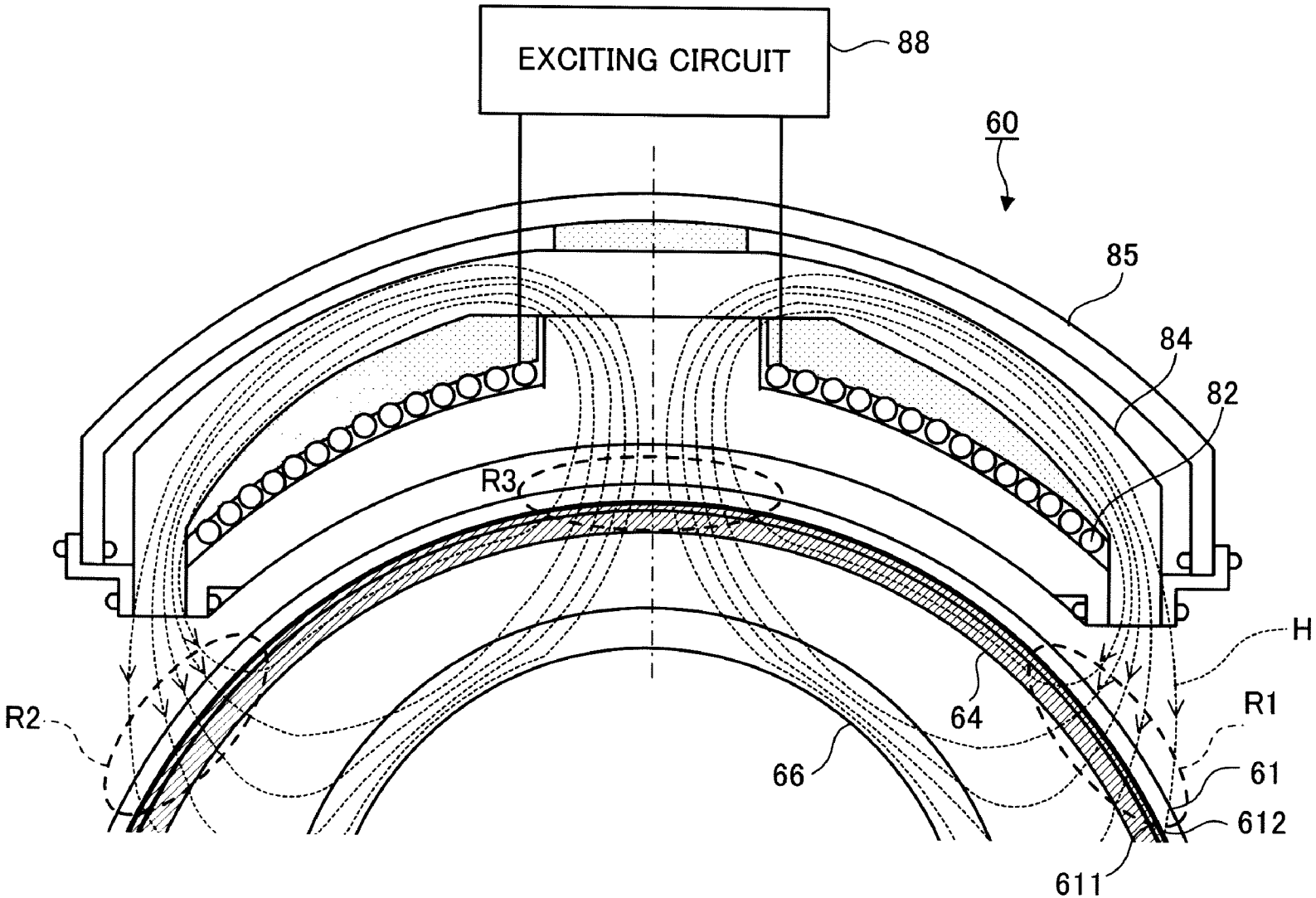
FIGS. 14 and 15 are views each illustrating a state of the magnetic field lines in the case where the temperature of the fixing belt is in a temperature range of the magnetic permeability change onset temperature and above, in the fixing apparatus of the second exemplary embodiment.
Figure 15:
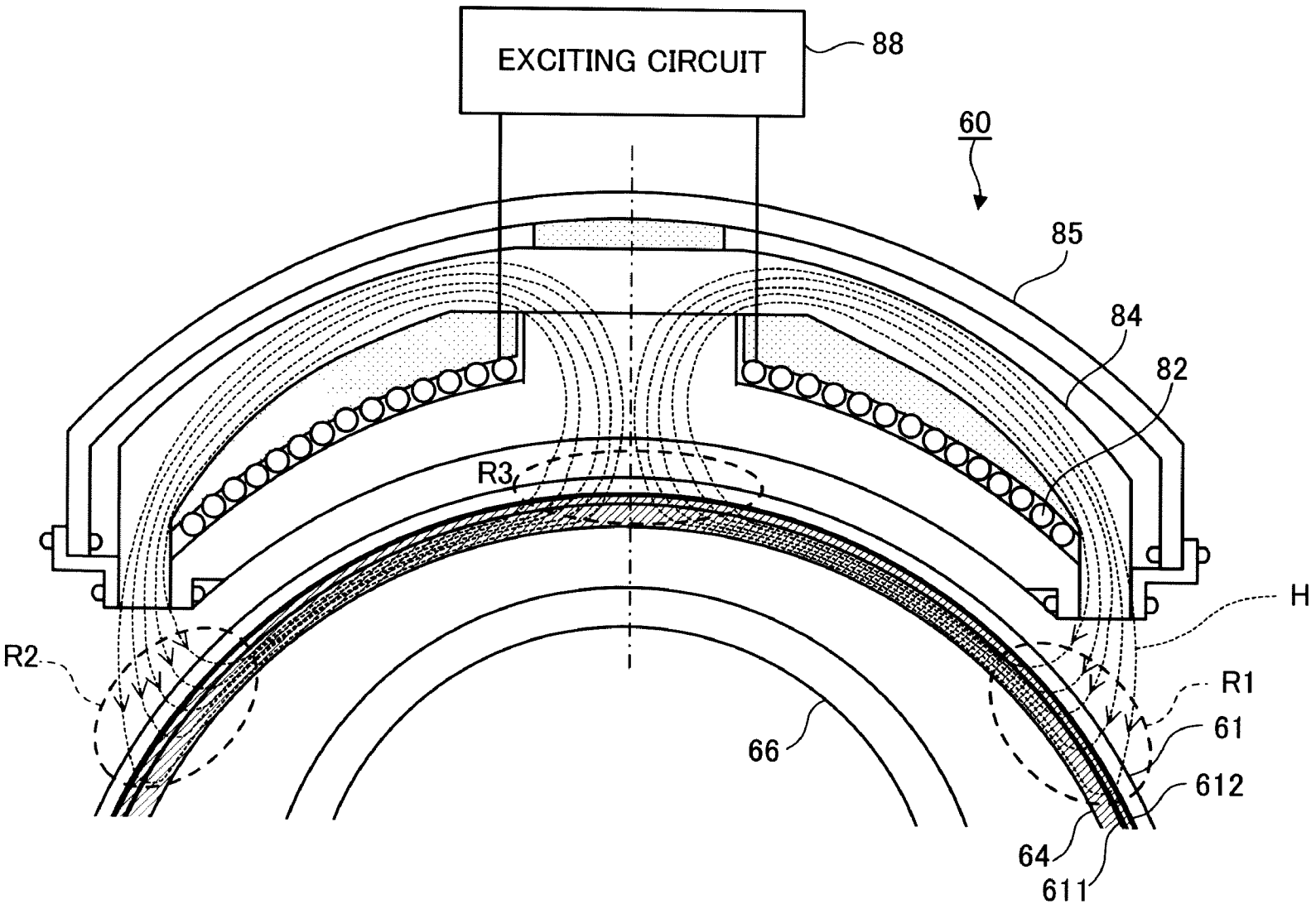

Next, FIGS. 14 and 15 are views each illustrating a state of the magnetic field lines H in the case where the temperature of the fixing belt 61 is in a temperature range of the magnetic permeability change onset temperature and above, in the fixing apparatus 60 of the second exemplary embodiment. FIG. 14 illustrates the case where a total thickness of the base layer 611 and the temperature-sensitive member 64 is set to be in a range from 149 μm, which is the skin depth (δ) in a state where they exhibit ferromagnetism, to less than 2978 μm, which is the skin depth (δ) in a state where they exhibit paramagnetism. Meanwhile, FIG. 15 illustrates the case where the thickness of the temperature-sensitive member 64 is set to be the skin depth (δ) in a state where it exhibits paramagnetism or larger.

As shown in FIGS. 14 and 15, when the temperature of the fixing belt 61 exceeds the magnetic permeability change onset temperature, the relative magnetic permeability of the base layer 611 and the temperature-sensitive member 64 decreases and is close to 1. Consequently, the magnetic field lines H of the alternating-current magnetic field generated by the IH heater 80 go through the base layer 611 and the temperature-sensitive member 64. The magnetic flux having gone through the temperature-sensitive member 64 is blocked at the nonmagnetic metal inducing member 66, and then forms a magnetic path. Accordingly, the amount of eddy current flowing in the conductive layer 612 of the fixing belt 61 is reduced.

To be more specific, the same mechanism as that in the first exemplary embodiment takes place. Accordingly, similarly to the case in the first exemplary embodiment, in the no-paper sheet fed region Fb in which the temperature is raised by, for example, continuous feeding of the small-sized paper sheet P1, the eddy current I generated in the conductive layer 612 of the fixing belt 61 is reduced, whereby the amount of heat generated in the no-paper sheet fed region Fb of the fixing belt 61 is reduced. Consequently, an excessive temperature rise in the no-paper sheet fed region Fb is prevented.

In the meantime, in the case where the thickness of the temperature-sensitive member 64 is set to be larger than the skin depth (δ) in a state where it exhibits paramagnetism, as shown in FIG. 15, the magnetic field lines H emitted from the magnetic core 84 go through the base layer 611 having a layer thickness of the skin depth (δ) in a state where it exhibits paramagnetism or smaller. Then, most of the magnetic field lines H having gone through the base layer 611 form a magnetic path in the temperature-sensitive member 64. Thus, the amount of the magnetic field lines H going across the temperature-sensitive member 64 in the thickness direction is reduced. However, since the thickness of the temperature-sensitive member 64 is large, according to the equation (2), the electric resistance R of the temperature-sensitive member 64 is reduced. Consequently, the eddy current I generated in the temperature-sensitive member 64 is increased, whereby the amount of heat generated in the temperature-sensitive member 64 is increased.

As described above, the temperature-sensitive member 64 having a thickness set to the skin depth (δ) in a state where it exhibits ferromagnetism or above itself generates heat even in the case where the temperature of the fixing belt 61 is in a temperature range of the magnetic permeability change onset temperature and above. Accordingly, in the case where the temperature-sensitive member 64 is arranged in contact with the inner peripheral surface of the fixing belt 61, the temperature of the temperature-sensitive member 64 itself acts to interfere with a decrease in the temperature of the no-paper sheet fed region Fb of the fixing belt 61. For this reason, when the thickness of the temperature-sensitive member 64 is set to be smaller than the skin depth (δ) in a state where it exhibits paramagnetism, the magnetic flux easily goes through the temperature-sensitive member 64 and forms a magnetic path at the nonmagnetic metal inducing member 66.

As described above, as for the temperature-sensitive member 64 of the second exemplary embodiment, while the temperature-sensitive member 64 is arranged in contact with the inner peripheral surface of the fixing belt 61, a total thickness of the base layer 611 and the temperature-sensitive member 64 is set to be larger than 149 μm, which is the skin depth (δ) in a state where they exhibit ferromagnetism, and smaller than the skin depth (δ) in a state where they exhibit paramagnetism. By having such a configuration, similarly to the first exemplary embodiment, a large amount of heat is generated in the fixing belt 61 in the case where the temperature of the fixing belt 61 is in a temperature range of the magnetic permeability change onset temperature and below. On the other hand, in the case where the temperature of the fixing belt 61 is in a temperature range of the magnetic permeability change onset temperature and above, the amount of heat generated in the fixing belt 61 is reduced, and an excessive temperature rise in the no-paper sheet fed region Fb is prevented. Meanwhile, mechanical strength, plasticity, flexibility of the fixing belt 61 are secured. Accordingly, stable rotation is achievable in a configuration in which the fixing belt 61 is rotated by directly receiving a driving force.

Furthermore, the fixing belt 61 is maintained at a heating preset temperature, and a phenomenon (so-called "temperature droop phenomenon") in which the temperature of the fixing belt 61 drops at the initiation of a high-speed fixing operation is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing apparatus comprising:

a fixing member that has a base layer and a conductive layer formed therein and fixes a toner onto a recording medium when the conductive layer is heated by electromagnetic induction;

a magnetic field generating member that generates an alternating-current magnetic field crossing the conductive layer formed in the fixing member; and a magnetic field inducing member that is arranged so as to face the magnetic field generating member across the fixing member, and that induces the alternating-current magnetic field generated in the magnetic field generating member thereinto or allows the alternating-current magnetic field to go therethrough, the base layer of the fixing member and the magnetic field inducing member each containing a material having a magnetic permeability change onset temperature in the range of not less than 140 degrees and not more than 240 degrees in a temperature range from not less than a heating preset temperature of the fixing member to not more than a heatproof temperature of the fixing member, and a thickness of the base layer being smaller than a skin depth of the base layer at the heating preset temperature of the fixing member.

2. The fixing apparatus according to claim 1, wherein the magnetic field inducing member is spaced from the fixing member by a predetermined distance.

3. The fixing apparatus according to claim 2, wherein the magnetic field inducing member has an eddy current dividing part formed therein, the eddy current dividing part dividing an eddy current generated by the alternating-current magnetic field generated in the magnetic field generating member.

4. The fixing apparatus according to claim 2, wherein the magnetic field inducing member contains a material having a magnetic permeability change onset temperature below the magnetic permeability change onset temperature of the base layer of the fixing member.

5. The fixing apparatus according to claim 1, wherein the magnetic field inducing member is arranged in contact with the fixing member.

6. The fixing apparatus according to claim 5, wherein the magnetic field inducing member contains a material having a magnetic permeability change onset temperature above the magnetic permeability change onset temperature of the base layer of the fixing member.

7. An image forming apparatus comprising:

a toner image forming unit that forms a toner image;

a transfer unit that transfers the toner image formed by the toner image forming unit onto a recording medium; and a fixing unit that fixes, onto the recording medium, the toner image transferred onto the recording medium, a fixing unit including:

a fixing member that has a base layer and a conductive layer formed therein and fixes a toner onto a recording medium when the conductive layer is heated by electromagnetic induction;

a magnetic field generating member that generates an alternating-current magnetic field crossing the conductive layer formed in the fixing member; and a magnetic field inducing member that is arranged so as to face the magnetic field generating member across the fixing member, and that induces the alternating-current magnetic field generated in the magnetic field generating member thereinto or allows the alternating-current magnetic field to go therethrough, the base layer of the fixing member and the magnetic field inducing member each containing a material having a magnetic permeability change onset temperature in the range of not less than 140 degrees and not more than 240 degrees in a temperature range from not less than a heating preset temperature of the fixing member to not more than a heatproof temperature of the fixing member, and a thickness of the base layer being smaller than a skin depth of the base layer at the heating preset temperature of the fixing member.

8. The image forming apparatus according to claim 7, wherein the fixing unit includes the magnetic field inducing member spaced from the fixing member by a predetermined distance.

9. The image forming apparatus according to claim 8, wherein the fixing unit includes the magnetic field inducing member having an eddy current dividing part formed therein, the eddy current dividing part dividing an eddy current generated by the alternating-current magnetic field generated in the magnetic field generating member.

10. The image forming apparatus according to claim 7, wherein the fixing unit includes the magnetic field inducing member arranged in contact with the fixing member.

11. The image forming apparatus according to claim 7, wherein the fixing unit includes the magnetic field inducing member containing a material having a magnetic permeability change onset temperature below the magnetic permeability change onset temperature of the base layer of the fixing member.

* * * * *